US011815316B2

(12) United States Patent
Shibata et al.

(10) Patent No.: US 11,815,316 B2
(45) Date of Patent: Nov. 14, 2023

(54) HEAT EXCHANGER AND HEAT PUMP SYSTEM HAVING SAME

(71) Applicant: DAIKIN INDUSTRIES, LTD., Osaka (JP)

(72) Inventors: Yutaka Shibata, Osaka (JP); Tomoki Hirokawa, Osaka (JP); Hirokazu Fujino, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/885,156

(22) Filed: Aug. 10, 2022

(65) Prior Publication Data

US 2022/0381519 A1 Dec. 1, 2022

Related U.S. Application Data

(63) Continuation of application No. PCT/JP2021/004958, filed on Feb. 10, 2021.

(30) Foreign Application Priority Data

Feb. 10, 2020 (JP) ..... 2020-021016

(51) Int. Cl.
*F28D 9/00* (2006.01)
*F28F 3/04* (2006.01)

(52) U.S. Cl.
CPC ..... *F28D 9/005* (2013.01); *F28F 3/048* (2013.01); *F28F 2260/02* (2013.01)

(58) Field of Classification Search
CPC ..... F28D 9/005; F28D 9/0075; F28F 3/048; F28F 2260/02; F28F 3/08; F28F 2260/00; F25B 7/00; F25B 39/02; F25B 39/04
See application file for complete search history.

(56) References Cited

U.S. PATENT DOCUMENTS 3,590,917 A * 7/1971 Huber ..... F25J 3/04412 165/DIG. 373
5,465,484 A 11/1995 Banks et al.
(Continued)

FOREIGN PATENT DOCUMENTS

CN 106403688 B 6/2019
EP 3572758 A1 11/2019
(Continued)

OTHER PUBLICATIONS

Extended European Search Report issued in corresponding European Patent Application No. EP 21754242.2 dated Dec. 22, 2022 (11 pages).

(Continued)

*Primary Examiner* — Tho V Duong
(74) *Attorney, Agent, or Firm* — Osha Bergman Watanabe & Burton LLP

(57) ABSTRACT

A heat exchanger includes: a first layer including first flow channels that are microchannels and arranged to extend side by side; and a second layer that is laminated on the first layer and that includes second flow channels that are microchannels and arranged to extend side by side. A first one end-side collective flow channel is in fluid communication with first ends of the first flow channels. A first other end-side collective flow channel is in fluid communication with second ends of the first flow channels. A second one end-side collective flow channel is in fluid communication with first ends of the second flow channels. A second other end-side collective flow channel is in fluid communication with second ends of the second flow channels.

18 Claims, 15 Drawing Sheets

(56) References Cited

U.S. PATENT DOCUMENTS

| | | | | |
|---|---|---|---|---|
| 8,793,987 | B2 * | 8/2014 | Berger | F28F 3/027 165/104.19 |
| 9,250,019 | B2 * | 2/2016 | Han | F28F 3/046 |
| 10,281,219 | B2 * | 5/2019 | Mizushita | F28F 3/08 |
| 2007/0298486 | A1 * | 12/2007 | Arora | B01J 19/0093 435/287.1 |
| 2012/0255288 | A1 | 10/2012 | Berger et al. | |
| 2016/0177829 | A1 * | 6/2016 | Loebig | F28D 9/0037 415/177 |

FOREIGN PATENT DOCUMENTS

| | | | |
|---|---|---|---|
| GB | 2162302 | A | 1/1986 |
| JP | S63-210595 | A | 9/1988 |
| JP | H7-502100 | A | 3/1995 |
| JP | 2004-261911 | A | 9/2004 |
| JP | 2007-529707 | A | 10/2007 |
| JP | 2010-286229 | A | 12/2010 |
| JP | 2015-105760 | A | 6/2015 |
| JP | 2015-230156 | A | 12/2015 |
| JP | 2018-189352 | A | 11/2018 |
| KR | 10-1228418 | B1 | 2/2013 |
| WO | 92/15830 | A1 | 9/1992 |
| WO | 2005/080901 | A1 | 9/2005 |

OTHER PUBLICATIONS

International Preliminary Report on Patentability issued in corresponding International Application No. PCT/JP2021/004958 dated Aug. 11, 2022 (6 pages).

International Search Report issued in corresponding International Application No. PCT/JP2021/004958 dated Mar. 23, 2021 (3 pages).

Notice of Reasons for Refusal issued in corresponding Japanese Application No. 2020-021016 dated Jul. 6, 2021 (8 pages).

Decision to Grant a Patent issued in corresponding Japanese Application No. 2020-021016 dated Sep. 28, 2021 (5 pages).

Extended European Search Report issued in corresponding European Patent Application No. Ep 21754242.2, dated Feb. 13, 2023 (12 pages).

* cited by examiner

HEAT EXCHANGER AND HEAT PUMP SYSTEM HAVING SAME

TECHNICAL FIELD

The present disclosure relates to a heat exchanger and a heat pump system having the same.

BACKGROUND

Heat exchangers having microchannels have been known. For example, Patent Documents 1 and 2 disclose such heat exchangers that each layer includes a flow channel for fluid supply and a flow channel for fluid flowing-out, which are in fluid communication with microchannels.

PATENT LITERATURE

Patent Document 1: Japanese Unexamined Patent Publication No. 2007-529707

Patent Document 2: Japanese Unexamined Patent Publication No. 2004-261911.

SUMMARY

A heat exchanger (100) according to one or more embodiments of the present disclosure including: a first layer (10) including a plurality of first flow channels (12) being microchannels and arranged to extend side by side, a first one end-side collective flow channel (17) being in fluid communication with one ends of the plurality of first flow channels (12), and a first other end-side collective flow channel (19) being in fluid communication with the other ends of the plurality of first flow channels (12); and a second layer (20) being laminated on the first layer (10) and including a plurality of second flow channels (22) being microchannels and arranged to extend side by side, a second one end-side collective flow channel (27) being in fluid communication with one ends of the plurality of second flow channels (22), and a second other end-side collective flow channel (29) being in fluid communication with the other ends of the plurality of second flow channels (22). The heat exchanger (100) is configured such that the first one end-side collective flow channel (17) and the first other end-side collective flow channel (19) include first microchannels A and B (15*a*, 15*b*), respectively, the first microchannels A and B (15*a*, 15*b*) extending in a direction crossing a direction in which the plurality of first flow channels (12) extend, and the second one end-side collective flow channel (27) and the second other end-side collective flow channel (29) include second microchannels A and B (25*a*, 25*b*), respectively, the second microchannels A and B (25*a*, 25*b*) extending in a direction crossing a direction in which the second flow channels (22) extend.

DETAILED DESCRIPTION

In the following, embodiments will be described in detail with reference to the drawings.

First Embodiments

<Heat Exchanger (100)>

Figure 1:
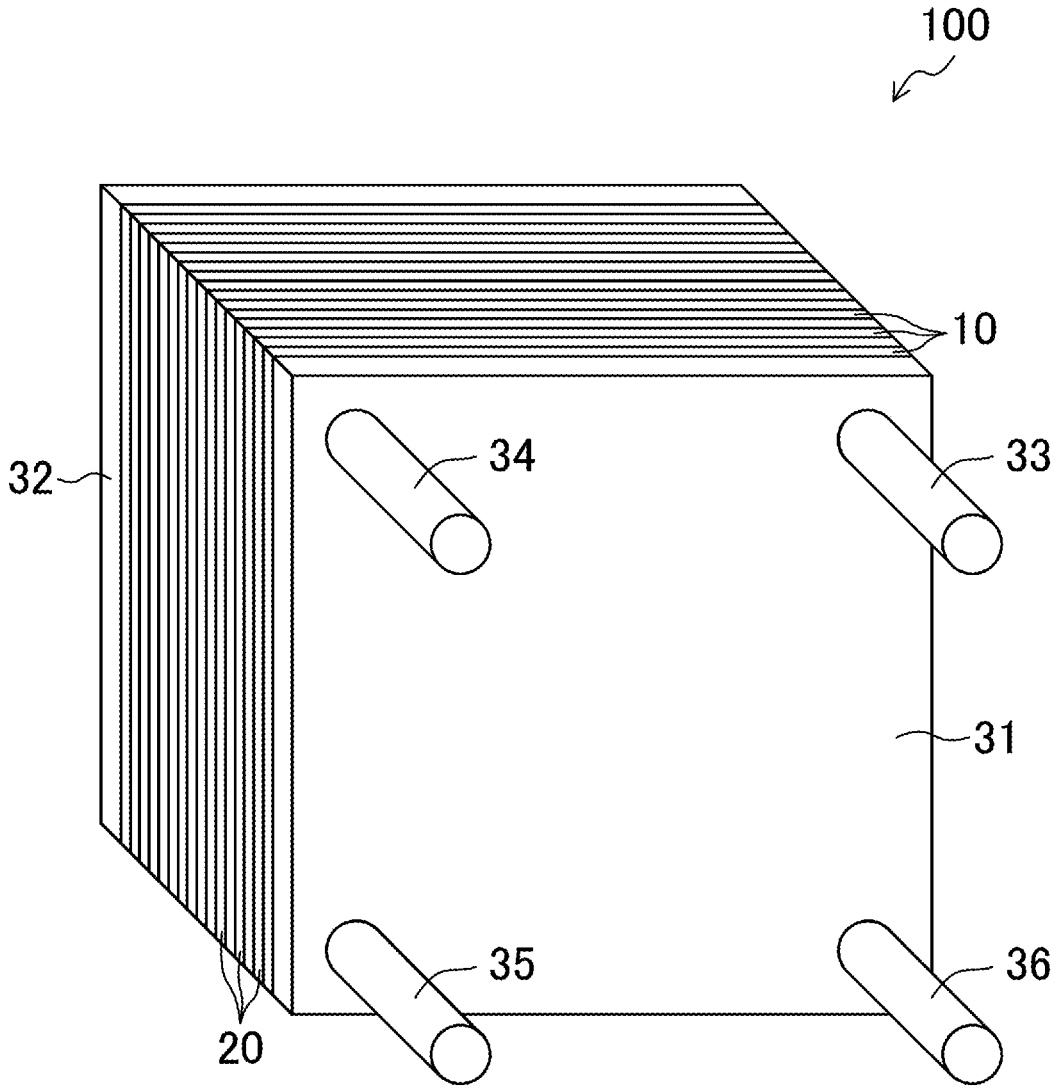
FIG. 1 is a perspective view of a heat exchanger (100) according to first embodiments.
Figure 2:
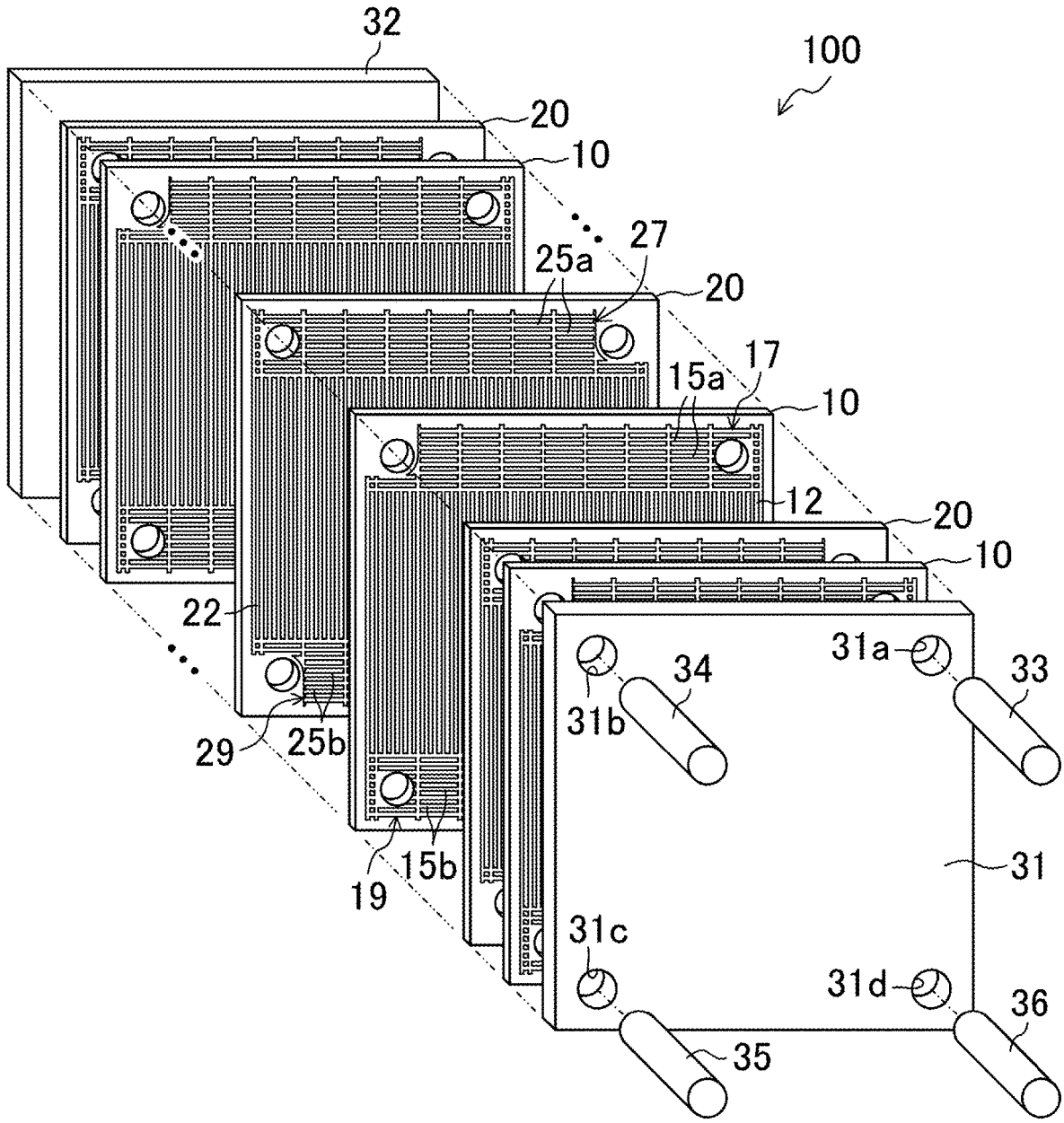
FIG. 2 is an exploded perspective view of the heat exchanger (100) according to the first embodiments.

FIGS. 1 and 2 illustrate a heat exchanger (100) according to first embodiments. The heat exchanger (100) according to the first embodiments may be applicable to a cascade condenser of a heat pump system (40), or the like, for example.

The heat exchanger (100) according to the first embodiments includes a plurality of first layers (10), a plurality of second layers (20), and a pair of end plates (31, 32). The first and second layers (10, 20) constitute an alternating lamination in which the first and second layers (10, 20) are alternately laminated. The first and second layers (10, 20) are configured to let first and second fluids flow therethrough, respectively, so as to perform interlayer heat exchange by condensing a gas in one of the first and second layers (10, 20) and evaporating a liquid in the other one of the first and second layers (10, 20). The pair of end plates (31, 32) is provided in such a way to sandwich the alternating lamination of the first and second layers (10, 20).

Figure 3:
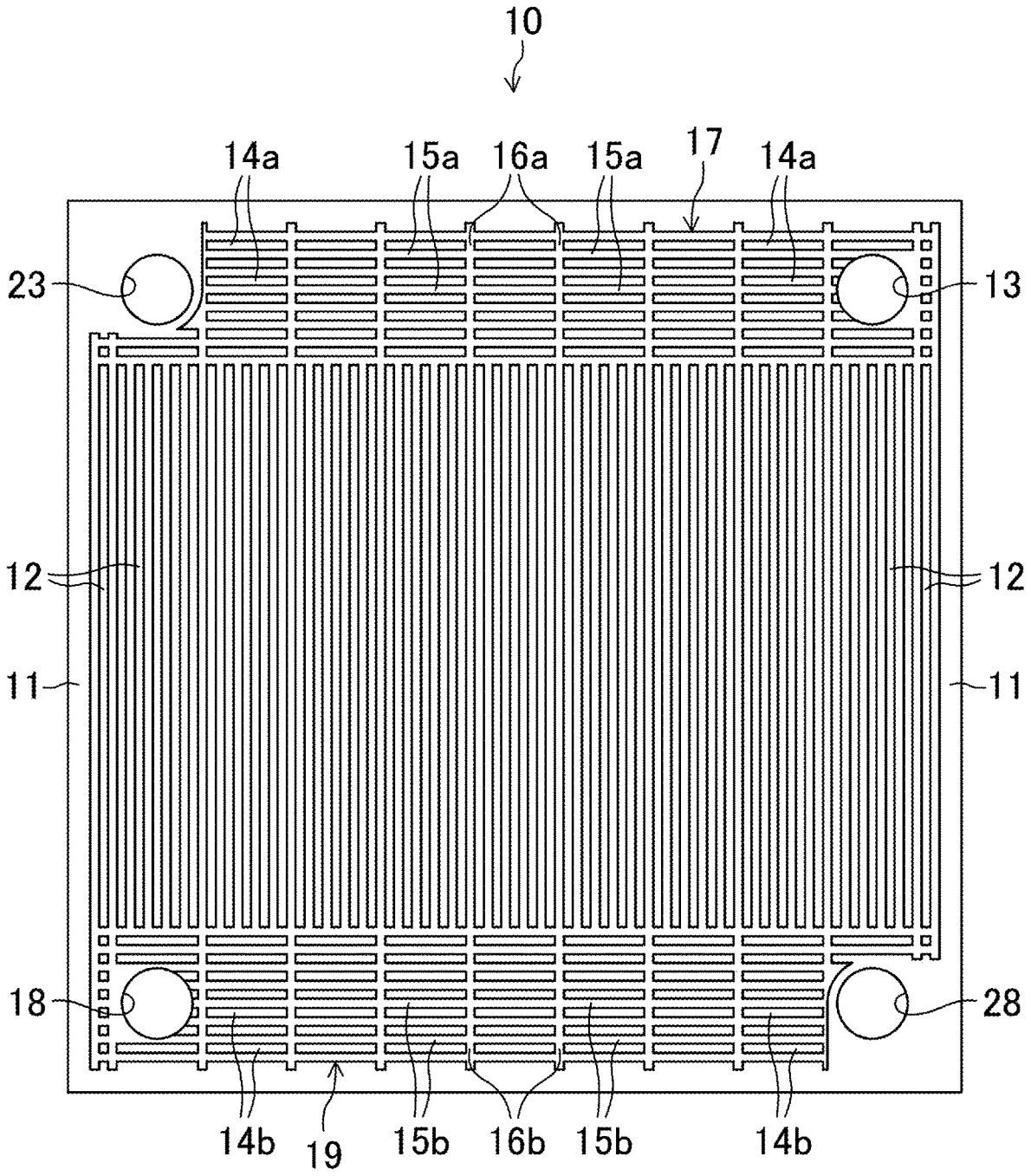
FIG. 3 is a plan view of a first layer (10).
Figure 4:
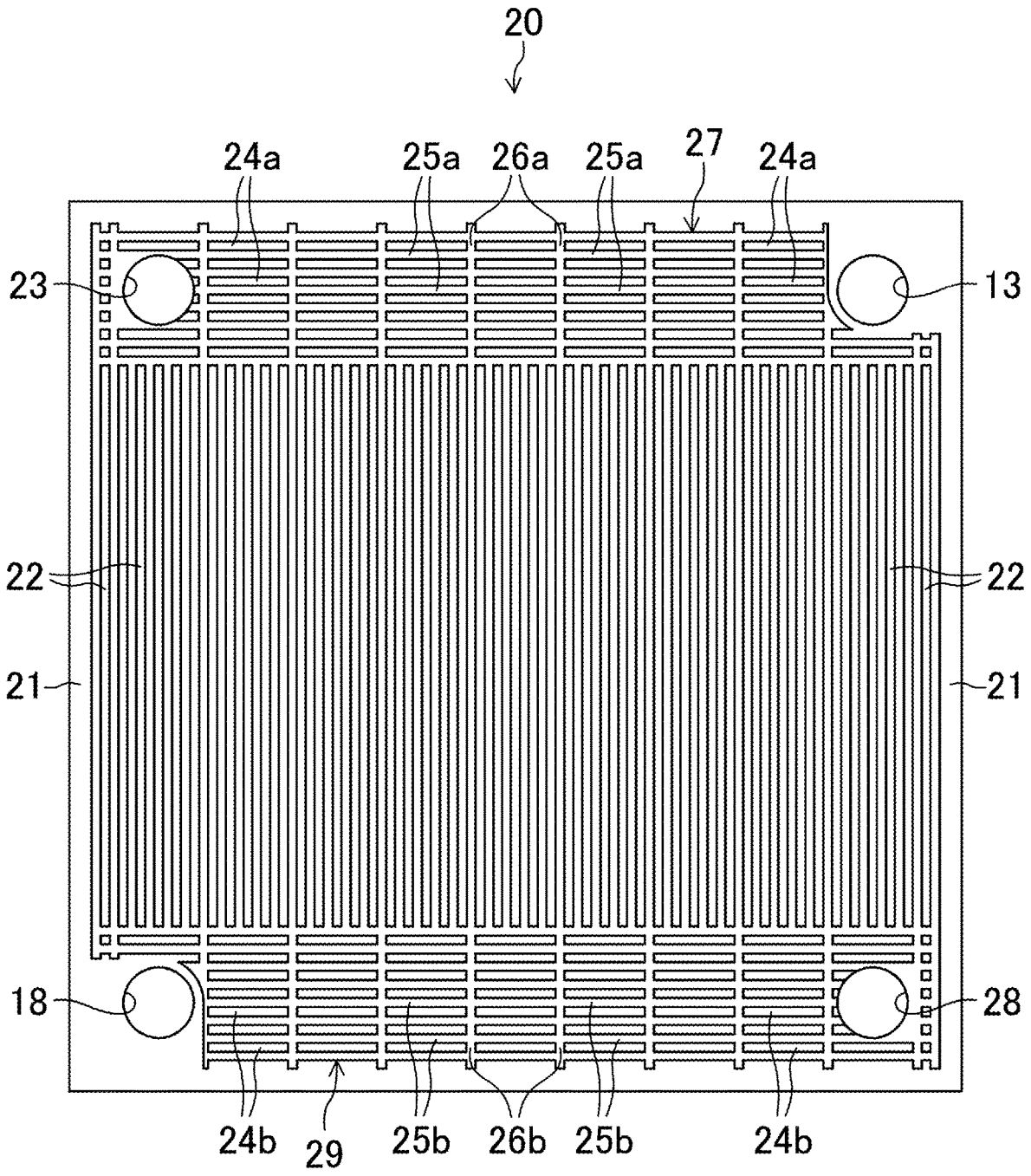
FIG. 4 is a plan view of a second layer (20).

FIG. 3 illustrates such a first layer (10). FIG. 4 illustrates such a second layer (20). It should be noted that expressions used in the following description for indicating directions such as "upper," "lower," "left," and "right" are just for the sake of convenience in explaining based on the drawings, but not for indicating how things are arranged or positioned actually in such directions.

Each of the first and second layers (10, 20) is made of a rectangular metal plate member. The first and second layers (10, 20) are so configured that a number of grooves are provided within a peripheral portion (11, 21) on one side of the first or second layer (10, 20) by mechanical processing or etching, as described later. These grooves form pores when openings of the grooves are sealed by laminating the first layer (10), second layer (20), or end plate (31) on the first or second layer (10, 20). In the present application, both the grooves of the first and second layers (10, 20) still open and the pores formed by sealing the openings thereof are referred to as "microchannels" or "flow channels."

Here, what is meant by the term "microchannel" in this application is a flow channel whose dimension in a lamination direction in which the first and second layers (10, 20) are laminated and width dimension in a direction perpendicular to the lamination direction are not less than 10 μm but not more than 1000 μm.

Figure 5:
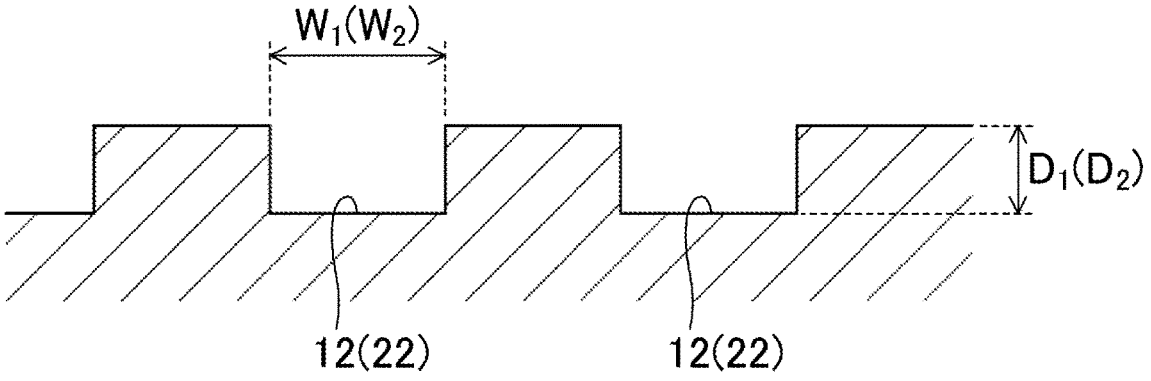
FIG. 5 is a cross-sectional view of first flow channels (12) (or second flow channels (22)).

The first layer (10) has a plurality of grooves in a middle portion thereof in the up-down direction as illustrated in FIG. 3 in such way that the plurality of grooves are aligned side by side in the right-left direction to extend straightly in the up-down direction. The plurality of grooves constitute a plurality of first flow channels (12) of the first layer (10). Similarly, the second layer (20) has a plurality of grooves in a middle portion thereof in the up-down direction as illustrated in FIG. 4 in such way that the plurality of grooves are aligned side by side in the right-left direction to extend straightly in the up-down direction. The plurality of grooves constitute a plurality of second flow channels (22) of the second layer (20). As illustrated in FIG. 5, the grooves constituting the first and second flow channels (12, 22) are rectangular in cross section. Moreover, the grooves constituting the first and second flow channels (12, 22) are not less than 10 μm but not more than 1000 μm in dimensions ($D_1$, $D_2$) in the lamination direction of the first and second layers (10, 20) and in width dimensions ($W_1$, $W_2$) in a direction perpendicular to the lamination direction. Thus, both the first and second flow channels (12, 22) are microchannels. The dimensional configurations of the first and second flow channels (12, 22) may be identical with each other or different from each other.

The first layer (10) has a first gas transport section (13) and a second gas transport section (23) respectively at an upper right corner portion and at an upper left corner portion of the first layer (10) on one-end side (upper side) with respect to the plurality of first flow channels (12) in the up-down direction, and the first gas transport section (13) and the second gas transport section (23) penetrate the first layer (10) in the thickness direction. In the region of the first layer (10) where the first gas transport section (13) is provided on the upper side with respect to the plurality of first flow channels (12), short ridges (14*a*) being rectangular in cross section and extending in the right-left direction are provided in tandem in the right-left direction with gaps therebetween and aligned side by side in the up-down direction with gaps therebetween.

Figure 6:
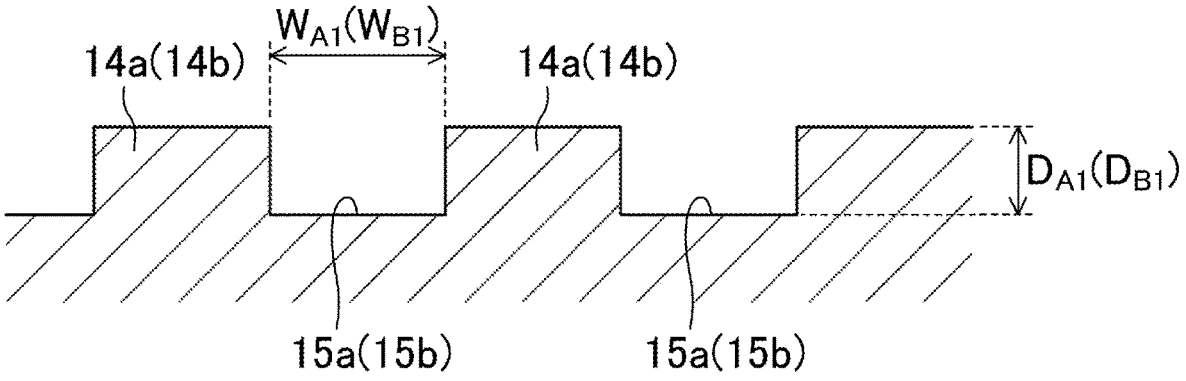
FIG. 6 is a cross-sectional view of first microchannels A (15*a*) (or first microchannels B (15*b*)).

Between ridges (14*a*) neighboring with each other in the up-down direction, a groove is formed, which has a rectangular cross section and extends straightly in the right-left direction perpendicular to the up-down direction in which the plurality of first flow channels (12) extend, as illustrated in FIG. 6. This groove constitutes a first microchannel A (15*a*). These first microchannels A (15*a*) are in fluid communication with each other not only in the right-left direction but also in the up-down direction through the gaps formed between neighboring ridges (14*a*) neighbored in the right-left direction. Such gaps between the ridges (14*a*) constitute first bypass flow channels A (16*a*) (first one end-side bypass flow channels).

In this way, the first layer (10) includes a first one end-side collective flow channel (17) on the upper side with respect to the plurality of first flow channels (12), the first one end-side collective flow channel (17) including the first microchannels A (15*a*) and the first bypass flow channels A (16*a*) and being in fluid communication with one ends of the first flow channels (12). Because the first gas transport section (13) is provided in the region where the first one end-side collective flow channel (17) is provided, the first one end-side collective flow channel (17) will maintain the fluid communication with the first gas transport section (13) even after the opening of the first one end-side collective flow channel (17) is sealed with the second layer (20) or the end plate (31). Thus, the first one end-side collective flow channel (17) constitutes a first gas flow channel. On the other hand, because the second gas transport section (23) is provided outside the region in which the first one end-side collective flow channel (17) is provided, the first one end-side collective flow channel (17) will be blocked from the second gas transport section (23) when the opening of the first one end-side collective flow channel (17) is sealed with the second layer (20) or the end plate (31).

The first layer (10) has a first liquid transport section (18) and a second liquid transport section (28) respectively at a lower left corner portion and at a lower right corner portion of the first layer (10) on the other-end side (lower side) with respect to the plurality of first flow channels (12) in the up-down direction, and the first liquid transport section (18) and the second liquid transport section (28) penetrate the first layer (10) in the thickness direction. In the region of the first layer (10) where the first liquid transport section (18) is provided on the lower side with respect to the plurality of first flow channels (12), short ridges (14*b*) being rectangular in cross section and extending in the right-left direction are provided in tandem in the right-left direction with gaps therebetween and aligned side by side in the up-down direction with gaps therebetween.

Figure 7:
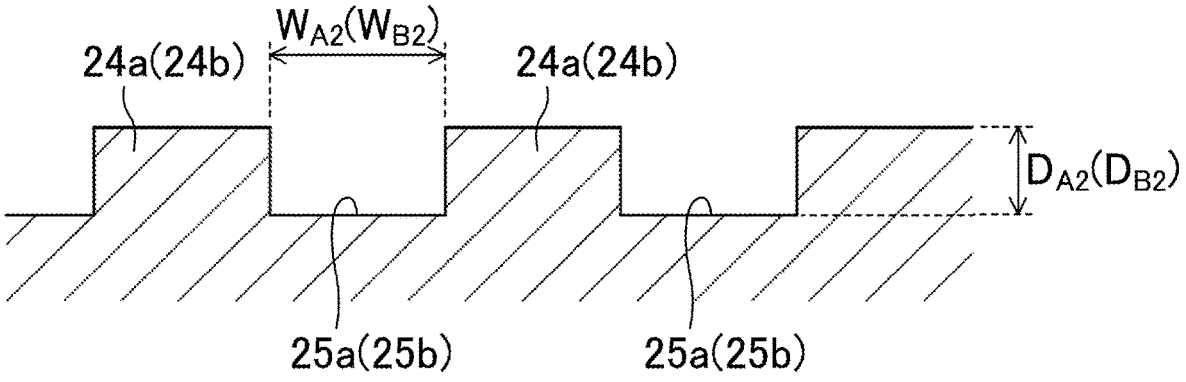
FIG. 7 is a cross-sectional view of second microchannels A (25*a*) (or second microchannels B (25*b*)).

Between ridges (14*b*) neighboring with each other in the up-down direction, a groove is formed, which has a rectangular cross section and extends straightly in the right-left direction perpendicular to the up-down direction in which the plurality of first flow channels (12) extend, as illustrated in FIG. 7. This groove constitutes a first microchannel B (15*b*). These first microchannels B (15*b*) are in fluid communication with each other not only in the right-left direction but also in the up-down direction through the gaps formed between neighboring ridges (14*b*) neighbored in the right-left direction. Such gaps between the ridges (14*b*) constitute first bypass flow channels B (16*b*) (first other end-side bypass flow channels).

In this way, the first layer (10) includes a first other end-side collective flow channel (19) on the lower side with respect to the plurality of first flow channels (12), the first other end-side collective flow channel (19) including the first microchannels B (15*b*) and the first bypass flow channels B (16*b*) and being in fluid communication with the other ends of the first flow channels (12). Because the first liquid transport section (18) is provided in the region where the first other end-side collective flow channel (19) is provided, the first other end-side collective flow channel (19) will maintain the fluid communication with the first liquid transport section (18) even after the opening of the first other end-side collective flow channel (19) is sealed with the second layer (20) or the end plate (31). Thus, the first other end-side collective flow channel (19) constitutes a first liquid flow channel. On the other hand, because the second liquid transport section (28) is provided outside the region in which the first other end-side collective flow channel (19) is provided, the first other end-side collective flow channel (19) will be blocked from the second liquid transport section (28) when the opening of the first other end-side collective flow channel (19) is sealed with the second layer (20) or the end plate (31).

The second layer (20) includes a first gas transport section (13) and a second gas transport section (23) respectively at an upper right corner portion and at an upper left corner portion of the second layer (20) on the one-end side (upper side) with respect to the plurality of second flow channels (22) in the up-down direction, and the first gas transport section (13) and the second gas transport section (23) penetrate the second layer (20) in the thickness direction. In the region of the second layer (20) where the second gas transport section (23) is provided on the upper side with respect to the plurality of second flow channels (22), short ridges (24*a*) being rectangular in cross section and extending in the right-left direction are provided in tandem in the right-left direction with gaps therebetween and aligned side by side in the up-down direction with gaps therebetween.

Between ridges (24*a*) neighboring with each other in the up-down direction, a groove is formed, which has a rectangular cross section and extends straightly in the right-left direction perpendicular to the up-down direction in which the plurality of second flow channels (22) extend, as illustrated in FIG. 6. This groove constitutes a second microchannel A (25*a*). These second microchannels A (25*a*) are in fluid communication with each other not only in the right-left direction but also in the up-down direction through the gaps formed between neighboring ridges (24*a*) neighbored in the right-left direction. Such gaps between the ridges (24*a*) constitute second bypass flow channels A (26*a*) (second one end-side bypass flow channels).

In this way, the second layer (20) includes a second one end-side collective flow channel (27) on the upper side with respect to the plurality of second flow channels (22), the second one end-side collective flow channel (27) including the second microchannels A (25*a*) and the second bypass flow channels A (26*a*) and being in fluid communication with one ends of the second flow channels (22). Because the second gas transport section (23) is provided in the region where the second one end-side collective flow channel (27) is provided, the second one end-side collective flow channel (27) will maintain the fluid communication with the second gas transport section (23) even after the opening of the second one end-side collective flow channel (27) is sealed with the first layer (10). Thus, the second one end-side collective flow channel (27) constitutes a second gas flow channel. On the other hand, because the first gas transport section (13) is provided outside the region in which the second one end-side collective flow channel (27) is provided, the second one end-side collective flow channel (27) will be blocked from the first gas transport section (13) when the opening of the second one end-side collective flow channel (27) is sealed with the first layer (10).

The second layer (20) includes a first liquid transport section (18) and a second liquid transport section (28) respectively at a lower left corner portion and at a lower right corner portion of the second layer (20) on the other-end side (lower side) with respect to the plurality of second flow channels (22) in the up-down direction, and the first liquid transport section (18) and the second liquid transport section (28) penetrate the second layer (20) in the thickness direction. In the region of the second layer (20) where the second liquid transport section (28) is provided on the lower side of the plurality of second flow channels (22), short ridges (24*b*) being rectangular in cross section and extending in the right-left direction are provided in tandem in the right-left direction with gaps therebetween and aligned side by side in the up-down direction with gaps therebetween.

Between ridges (24*b*) neighboring with each other in the up-down direction, a groove is formed, which has a rectangular cross section and extends straightly in the right-left direction perpendicular to the up-down direction in which the plurality of second flow channels (22) extend, as illustrated in FIG. 7. This groove constitutes a second microchannel B (25*b*). These second microchannels B (25*b*) are in fluid communication with each other not only in the right-left direction but also in the up-down direction through the gaps formed between neighboring ridges (24*b*) neighbored in the right-left direction. Such gaps between the ridges (24*b*) constitute second bypass flow channels B (26*b*) (second other end-side bypass flow channels).

In this way, the second layer (20) includes a second other end-side collective flow channel (29) on the lower side with respect to the plurality of second flow channels (22), the second other end-side collective flow channel (29) including the second microchannels B (25*b*) and the second bypass flow channels B (26*b*) and being in fluid communication with the other ends of the second flow channels (22). Because the second liquid transport section (28) is provided in the region where the second other end-side collective flow channel (29) is provided, the second other end-side collective flow channel (29) will maintain the fluid communication with the second liquid transport section (28) even after the opening of the second other end-side collective flow channel (29) is sealed with the first layer (10). Thus, the second other end-side collective flow channel (29) constitutes a second liquid flow channel. On the other hand, because the first liquid transport section (18) is provided outside the region in which the second other end-side collective flow channel (29) is provided, the second other end-side collective flow channel (29) will be blocked from the first liquid transport section (18) when the opening of the second other end-side collective flow channel (29) is sealed with the first layer (10).

Figure 8:
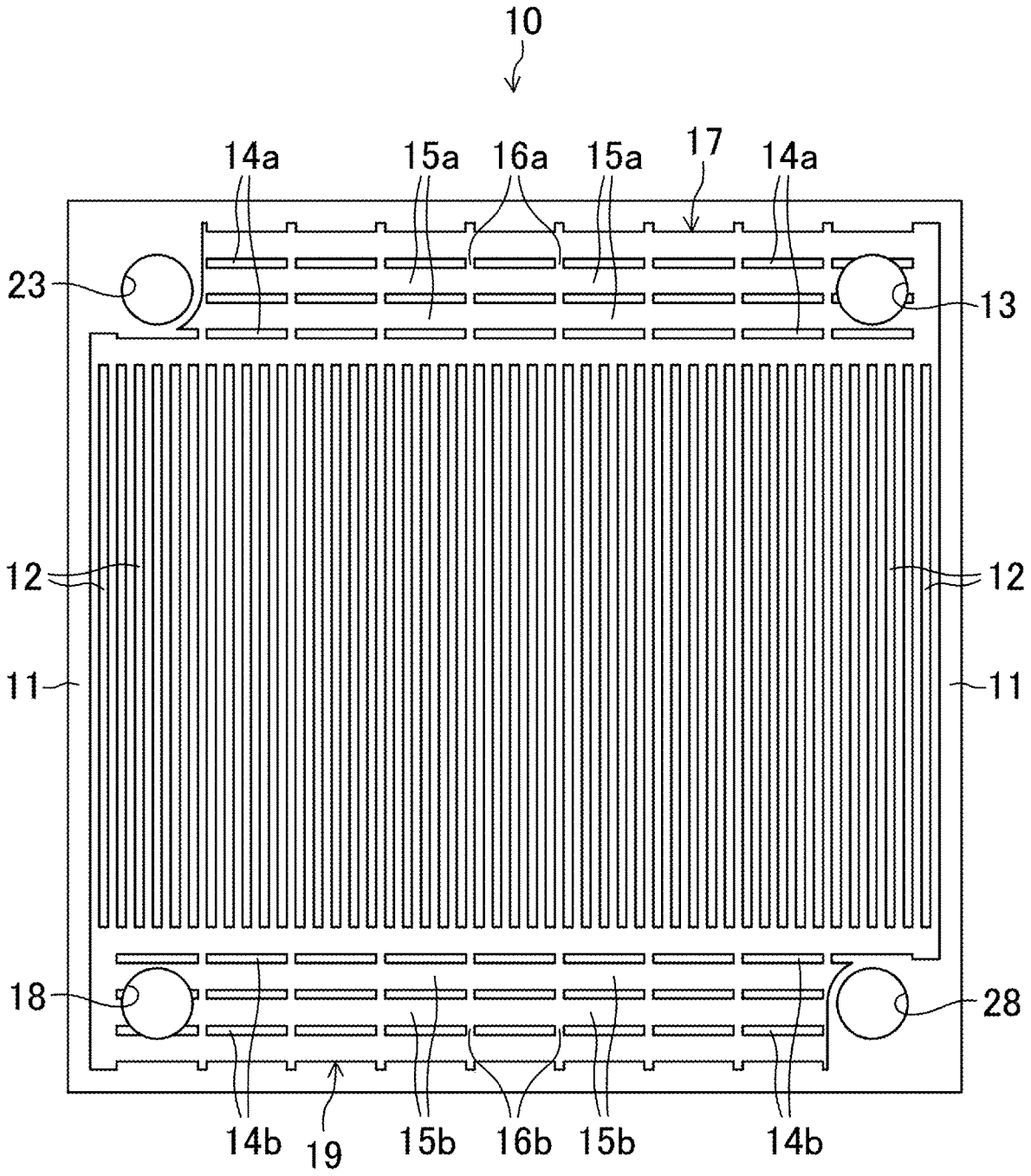
FIG. 8 is a plan view of a modification of the first layer (10) of the first embodiments.

The first microchannels A (15*a*) of the first one end-side collective flow channel (17) and the first microchannels B (15*b*) of the first other end-side collective flow channel (19) of the first layer (10) are not less than 10 μm but not more than 1000 μm both in dimensions ($D_{A1}$, $D_{B1}$) in the lamination direction of the first and second layers (10, 20) and in width dimensions ($W_{A1}$, $W_{B1}$) in a direction perpendicular to the lamination direction. The dimensional configurations of the first microchannels A and B (15*a*, 15*b*) may be identical with the first flow channels (12) or different from the first flow channels (12). However, for securing a flow amount of the first fluid flowing through the first microchannels A and B (15*a*, 15*b*) while avoiding an excessive pressure loss of the first fluid, the first microchannels A and B (15*a*, 15*b*) may be configured such that the dimensions ($D_{A1}$, $D_{B1}$) in the lamination direction of the first and second layers (10, 20) are equal to that of the first flow channels (12) and the width dimensions ($W_{A1}$, $W_{B1}$) in the direction perpendicular to the lamination direction are equal to that of the first flow channels (12) as illustrated in FIG. 3, or greater than that of the first flow channels (12) as illustrated in FIG. 8, or more specifically dimensional ratios of the width dimensions ($W_{A1}$, $W_{B1}$) of the first microchannels A and B (15*a*, 15*b*) with respect to that of the first flow channels (12) may be one time or more but three times or less. Moreover, the first bypass flow channels A and B (16*a*, 16*b*) may be microchannels.

Figure 9:
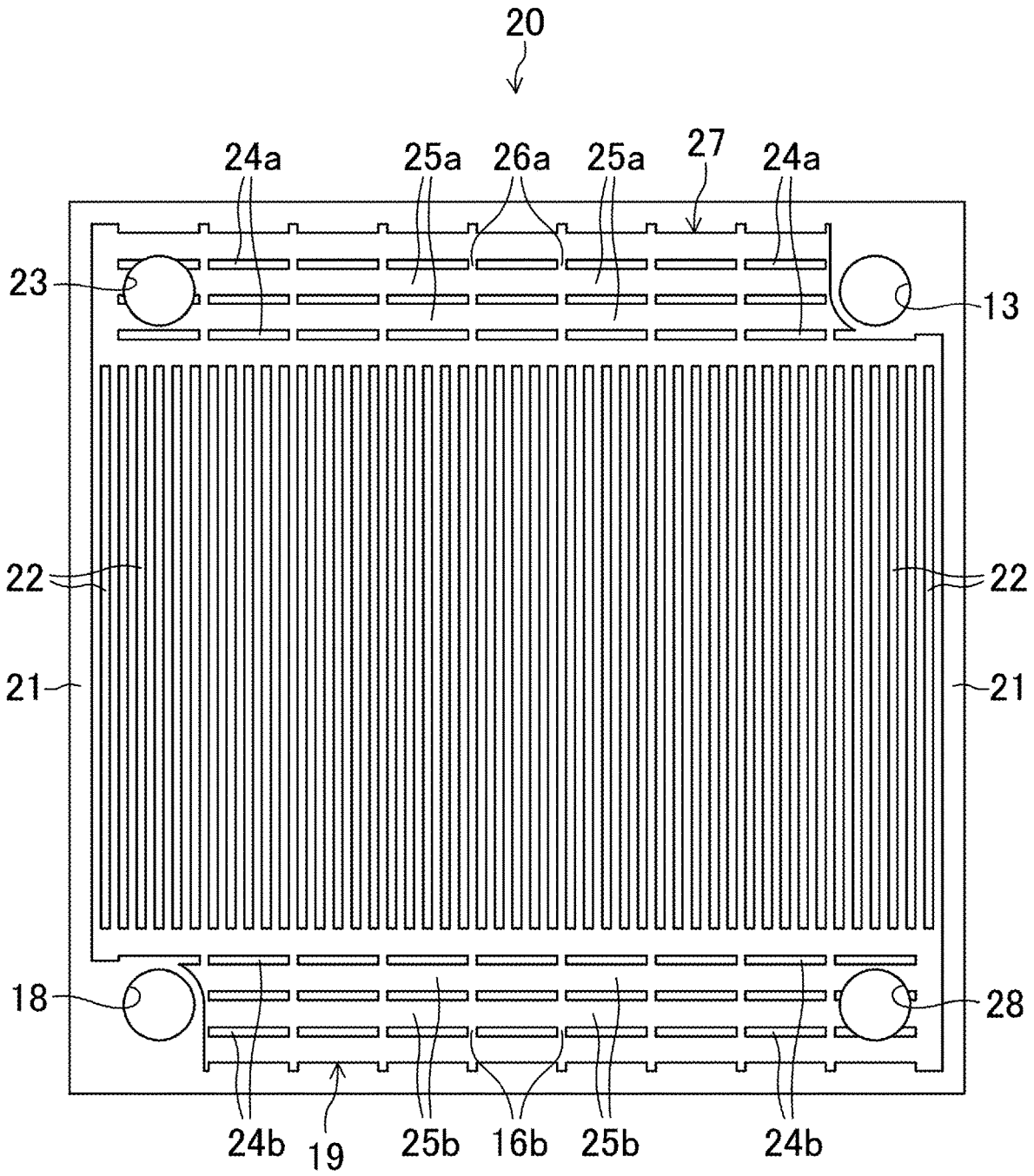
FIG. 9 is a plan view of a modification of the second layer (20) of the first embodiments.

The second microchannels A (25*a*) of the second one end-side collective flow channel (27) and the second microchannels B (25*b*) of the second other end-side collective flow channel (29) of the second layer (20) are such that dimensions ($D_{A2}$, $D_{B2}$) in the lamination direction of the first and second layers (10, 20) and width dimensions ($W_{A2}$, $W_{B2}$) in the direction perpendicular to the lamination direction are not less than 10 μm but not more than 1000 μm. The dimensional configurations of the second microchannels A and B (25*a*, 25*b*) may be identical with the second flow channels (22) or different from the second flow channels (22). However, for securing a flow amount of a second fluid flowing through the second microchannels A and B (25*a*, 25*b*) while avoiding an excessive pressure loss of the second fluid, the second microchannels A and B (25*a*, 25*b*) may be configured such that the dimensions ($D_{A2}$, $D_{B2}$) in the lamination direction of the first and second layers (10, 20) are equal to that of the second flow channels (22) and the width dimensions ($W_{A2}$, $W_{B2}$) in the direction perpendicular to the lamination direction are equal to that of the second flow channels (22) as illustrated in FIG. 4, or greater than that of the second flow channels (22) as illustrated in FIG. 9, or more specifically dimensional ratios of the width dimensions ($W_{A2}$, $W_{B2}$) of the second microchannels A and B (25*a*, 25*b*) with respect to that of the second flow channels (22) may be one time or more but three times or less. Moreover, the second bypass channels A and B (26*a*, 26*b*) may be microchannels.

The first layer (10) may be produced in such a way that both the first flow channels (12) and the first microchannels A and B (15*a*, 15*b*) are fabricated at the same time because the first flow channels (12) and the first microchannels A and B (15*a*, 15*b*) are all microchannels. Similarly, the second layer (20) may be produced in such a way that both the second flow channels (22) and the second microchannels A and B (25*a*, 25*b*) are fabricated at the same time because the second flow channels (22) and the second microchannels A and B (25*a*, 25*b*) are all microchannels.

In an alternating lamination in which the first and second layers (10, 20) are alternately laminated, the first gas transport sections (13), the second gas transport sections (23), the first liquid transport sections (18), and the second liquid transport sections (28) of the first and second layers (10, 20) thus laminated are sequentially joined to form tubular geometries, respectively.

The tubular geometries formed with the first gas transport sections (13) and the first liquid transport sections (18) are in fluid communication with the flow channels in the first layer (10) but not with the flow channels in the second layer (20). Therefore, after supplied to one of the tubular geometries formed by the first gas transport sections (13) or the first liquid transport sections (18), the first fluid is distributed to the first layers (10) but not to the second layers (20), so that the first fluid flows through the first flow channels (12), the first one end-side collective flow channel (17), and the first other end-side collective flow channel (19) inside the first layers (10), and merges at the other side and flows out collectively from the first layers (10).

The tubular geometries formed from the second gas transport sections (23) and the second liquid transport sections (28) are in fluid communication with the flow channels in the second layer (20) but not with the flow channels in the first layer (10). Therefore, after supplied to one of the tubular geometries formed by the second gas transport sections (23) or the second liquid transport sections (28), the second fluid is distributed to the second layers (20) but not to the first layers (10), so that the second fluid flows through the second flow channels (22), the second one end-side collective flow channel (27), and the second other end-side collective flow channel (29) inside the second layers (20), and merges at the other side and flows out collectively from the second layers (20).

Figure 10:
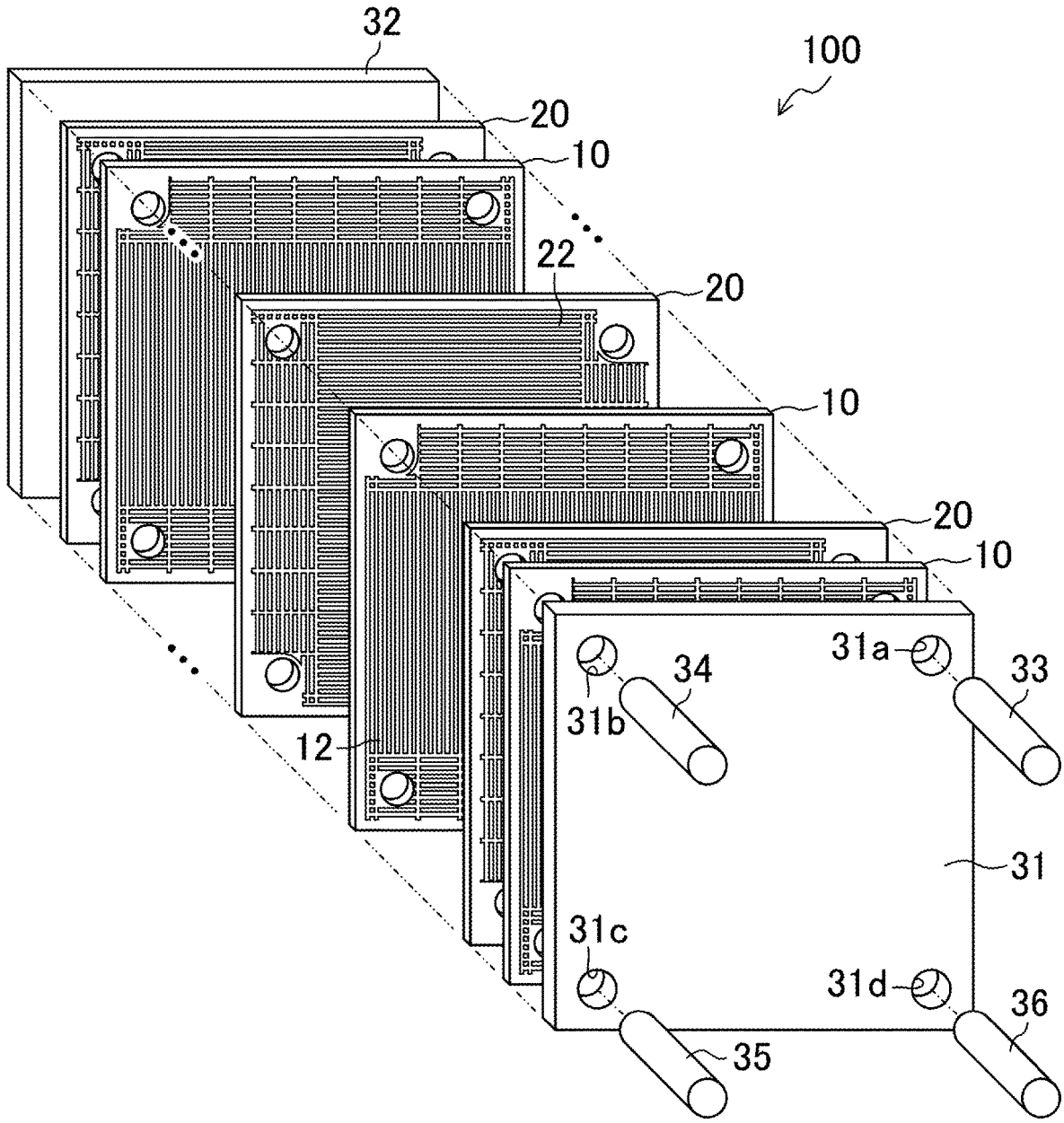
FIG. 10 is an exploded perspective view of a modification of the heat exchanger (100) of the first embodiments.

The alternating lamination of the first and second layers (10, 20) is so configured that the first and second layers (10, 20) are laminated with each other in such a way that the first and second flow channels (12, 22) extend parallel to each other, as illustrated in FIG. 2. In this case, the first fluid in the first flow channels (12) of the first layer (10) and the second fluid in the second flow channels (22) of the second layer (20) flow in opposite directions in the plan view. As an alternative, as long as the first and second layers (10, 20) having the same configuration are used, the alternating lamination of the first and second layers (10, 20) may be so configured that the first and second layers (10, 20) are laminated with each other in such a way that the first and second flow channels (12, 22) extend perpendicularly to each other, as illustrated in FIG. 10. In this case, the first fluid in the first flow channels (12) of the first layer (10) and the second fluid in the second flow channels (22) of the second layer (20) flow in directions perpendicular to each other in the plan view.

The pair of end plates (31, 32) is constituted by a rectangular metal plate member, which has a shape identical with those of the first and second layers (10, 20). The end plate (31), which is one of the pair, is laminated on one side of the alternating lamination of the first and second layers (10, 20). The end plate (31) has four pores (31*a*, 31*b*, 31*c*, 31*d*), which correspond to the tubular geometries formed with the first gas transport sections (13), the second gas transport sections (23), the first liquid transport sections (18), and the second liquid transport sections (28) of the first and second layers (10, 20), respectively, and the four pores (31*a*, 31*b*, 31*c*, 31*d*) are connected with a first gas inlet/outlet pipe (33), a second gas inlet/outlet pipe (34), a first liquid inlet/outlet pipe (35), and a second liquid inlet/outlet pipe (36), respectively. The end plate (32), which is the other one of the pair, is laminated on the other side of the alternating lamination of the first and second layers (10, 20) to seal the tubular geometries formed with the first gas transport sections (13), the second gas transport sections (23), the first liquid transport sections (18), and the second liquid transport sections (28).

Each of the first and second fluids for flowing in the first and second layers (10, 20) may be a CFC refrigerant or a natural refrigerant, independently. Examples of the CFC refrigerant include R410A, R32, R134a, HFO, and the like. Examples of the natural refrigerant include $CO_2$, hydrocarbon such as propane, and the like.

The heat exchanger (100) according to the first embodiments with the configuration described above is such that, in each first layer (10), the first one end-side collective flow channel (17) and the first other end-side collective flow channel (19) are in fluid communication with the plurality of first flow channels (12), which are microchannels, and one of the first one end-side collective flow channel (17) or the first other end-side collective flow channel (19) is for distributively supplying the first fluid to the first flow channels (12), and the other one of the first one end-side collective flow channel (17) or the first other end-side collective flow channel (19) is for merging the first fluid flowing out from the first flow channels (12) so as to let the first fluid flow out collectively from the first layer (10). More specifically, in a case of performing gas condensation in the first layer (10), the first gas transport section (13) supplies the first fluid containing the gas as the condensation source to the first one end-side collective flow channel (17), the first one end-side collective flow channel (17) distributively supplies the first fluid to the plurality of first flow channels (12), the gas is then condensed in the plurality of first flow channels (12), and the first other end-side collective flow channel (19) merges the first fluid thus condensed and flowed out from the plurality of first flow channels (12), so as to let the first fluid flow out collectively via the first liquid transport section (18). In a case of performing liquid evaporation in the first layer (10), the first liquid transport section (18) supplies the first fluid containing the liquid as the evaporation source to the first other end-side collective flow channel (19), the first other end-side collective flow channel (19) distributively supplies the first fluid to the plurality of first flow channels (12), the liquid is then evaporated in the plurality of first flow channels (12), and the first one end-side collective flow channel (17) merges the first fluid thus evaporated and flowed out from the plurality of first flow channels (12), so as to let the first fluid flow out collectively via the first gas transport section (13). Moreover, the first one end-side collective flow channel (17) and the first other end-side collective flow channel (19) include the first microchannels A and B (15*a*, 15*b*), respectively, the first microchannels A and B (15*a*, 15*b*) extending in the right-left direction perpendicular to (or crossing) the up-down direction in which the plurality of first flow channels (12) extend.

Similarly, each second layer (20) is configured such that the second one end-side collective flow channel (27) and the second other end-side collective flow channel (29) are in fluid communication with a plurality of second flow channels (22), which are microchannels, and one of the second one end-side collective flow channel (27) or the second other end-side collective flow channel (29) is for distributively supplying the second fluid to the plurality of second flow channels (22) and the other one of the second one end-side collective flow channel (27) or the second other end-side collective flow channel (29) is for merging the second fluid flowing out from the plurality of second flow channels (22) so as to let the fluid flow out collectively from the second layer (20). More specifically, in a case of performing gas condensation in the second layer (20), the second gas transport section (23) supplies the second fluid containing the gas as the condensation source to the second one end-side collective flow channel (27), the second one end-side collective flow channel (27) distributively supplies the second fluid to the plurality of second flow channels (22), the gas is then condensed in the plurality of second flow channels (22), and the second other end-side collective flow channel (29) merges the second fluid thus condensed and flowed out from the second flow channels (22), so as to let the second fluid flow out collectively via the second liquid transport section (28). In a case of performing liquid evaporation in the second layer (20), the second liquid transport section (28) supplies the second fluid containing the liquid as the evaporation source to the second other end-side collective flow channel (29), the second other end-side collective flow channel (29) distributively supplies the second fluid to the plurality of second flow channels (22), the liquid is then evaporated in the plurality of second flow channels (22), and the second one end-side collective flow channel (27) merges the second fluid thus evaporated and flowed out from the second flow channels (22), so as to let the second fluid flow out collectively via the second gas transport section (23). Moreover, the second one end-side collective flow channel (27) and the second other end-side collective flow channel (29) include second microchannels A and B (25*a*, 25*b*), respectively, the second microchannels A and B (25*a*, 25*b*) extending in the right-left direction perpendicular to (or crossing) the up-down direction in which the plurality of second flow channels (22) extend.

This makes it possible to facilitate elimination of the need of a large space for the first one end-side collective flow channel (17) and the first other end-side collective flow channel (19) in the first layer (10), and to facilitate elimination of the need of a large space for the second one end-side collective flow channel (27) and the second other end-side collective flow channel (29) in the second layer (20). This also makes it possible to facilitate the reduction of the thickness necessary for withstanding pressures of the first and second fluids flowing through the first one end-side collective flow channel (17) and the first other end-side collective flow channel (19), and of the fluid flowing through the second one end-side collective flow channel (27) and the second other end-side collective flow channel (29), thereby making it unnecessary to form the end plates (31, 32) with a greater thickness. Therefore, this makes it possible to achieve the efficacies of the space saving and weight reduction.

<Heat Pump System (40)>

Figure 11:
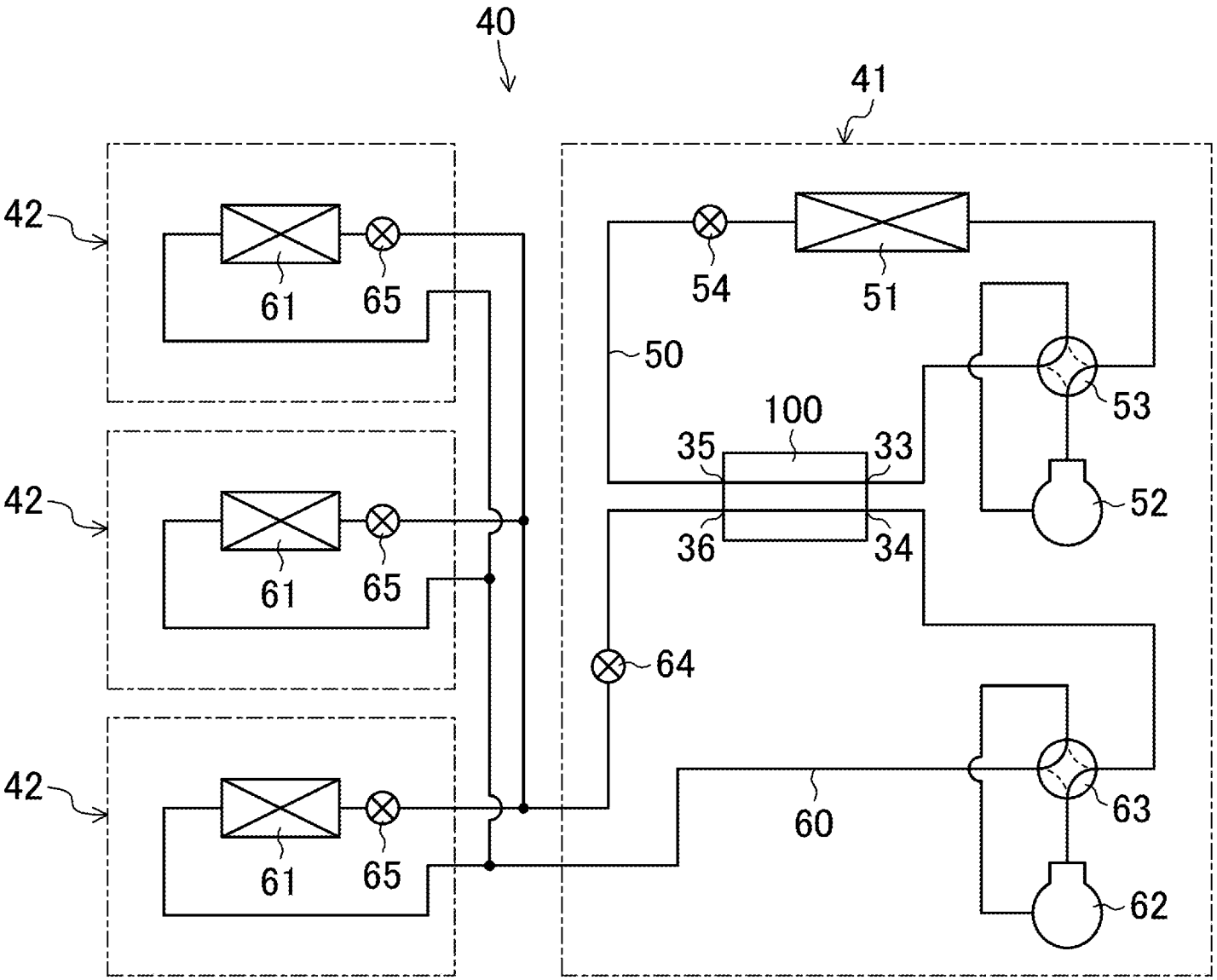
FIG. 11 is a schematic diagram of one example of a heat pump system (40) having the heat exchanger (100) of the first embodiments.

FIG. 11 illustrates one example of a heat pump system (40) including the heat exchanger (100) according to the first embodiments as a cascade condenser.

The heat pump system (40) includes an outdoor unit (41) including the heat exchanger (100) according to the first embodiments and a plurality of indoor units (42). Furthermore, the heat pump system (40) includes first and second refrigerant circuits (50, 60).

The first refrigerant circuit (50) is provided in the outdoor unit (41) and is configured such that one end and the other end of the first refrigerant circuit (50) are connected with the first gas inlet/outlet pipe (33) and the first liquid inlet/outlet pipe (35) of the heat exchanger (100) according to the first embodiments, respectively. The first refrigerant circuit (50) includes an outdoor air heat exchanger (51). The first refrigerant circuit (50) is such that a flow channel switching structure is provided between a joint portion with the first gas inlet/outlet pipe (33) and the outdoor air heat exchanger (51), the flow channel switching structure including a first compressor (52) and a first four-way switching valve (53). The first refrigerant circuit (50) is such that a first expansion valve (54) is provided between a joint portion with the first liquid inlet/outlet pipe (35) and the outdoor air heat exchanger (51).

The second refrigerant circuit (60) is provided such that the second refrigerant circuit (60) extends out of the outdoor unit (41), branches out to run through the respective indoor units (42), merges after coming out from the indoor units (42), and returns to the outdoor unit (41), and one end and the other end of the second refrigerant circuit (60) are connected with the second gas inlet/outlet pipe (34) and the second liquid inlet/outlet pipe (36) of the heat exchanger (100) according to the first embodiments, respectively. The second refrigerant circuit (60) includes an indoor air heat exchanger (61) inside each indoor unit (42). The second refrigerant circuit (60) is such that, inside the outdoor unit (41), a flow channel switching structure is provided between a joint portion with the second gas inlet/outlet pipe (34) and a portion extending toward the indoor air heat exchangers (61) in the indoor units (42), the flow channel switching structure including a second compressor (62) and a second four-way switching valve (63). The second refrigerant circuit (60) is such that, between a joint portion with the second liquid inlet/outlet pipe (36) and the portion extending toward the indoor air heat exchangers (61) inside the indoor units (42), a second outdoor expansion valve (64) is provided in the outdoor unit (41) and a second indoor expansion valve (65) is provided in each indoor unit (42).

<Cooling Operation>

In the heat pump system (40), cooling operation of the indoor units (42) is carried out in such a way that the first four-way switching valve (53) switches over the flow channel so that a first refrigerant (first fluid), which has been boosted in pressure and temperature by the first compressor (52), is sent to the outdoor air heat exchanger (51). The first refrigerant thus sent to the outdoor air heat exchanger (51) releases heat to condense in the outdoor air heat exchanger (51) through heat exchange with outdoor air. The first refrigerant thus condensed in the outdoor air heat exchanger (51) is sent to the heat exchanger (100) according to the first embodiments after depressurized by the first expansion valve (54). On the other hand, the second four-way switching valve (63) switches over the flow channel so that a second refrigerant (second fluid), which has been boosted in pressure and temperature by the second compressor (62), is sent to the heat exchanger (100) according to the first embodiments.

In the heat exchanger (100) according to the first embodiments, the first refrigerant flows thereinto via the first liquid inlet/outlet pipe (35) and is distributed to the plurality of first layers (10), in each of which the first refrigerant flows through the plurality of first flow channels (12) via the first other end-side collective flow channel (19). Moreover, the second refrigerant flows into the heat exchanger (100) according to the first embodiments via the second gas inlet/outlet pipe (34) and is distributed to the plurality of second layers (20), in each of which the second refrigerant flows through the plurality of second flow channels (22) via the second one end-side collective flow channel (27). When the first and second refrigerants flow in the first and second layers (10, 20) as above, the heat exchange takes place between the first and second layers (10, 20), thereby causing the first refrigerant to absorb heat to evaporate in the first layers (10), while causing the second refrigerant to release the heat to condense in the second layers (20). The first refrigerant thus evaporated in the first layers (10) flows through the first one end-side collective flow channel (17) and flows out via the first gas inlet/outlet pipe (33). The second refrigerant thus condensed in the second layers (20) flows through the second other end-side collective flow channel (29) and flows out via the second liquid inlet/outlet pipe (36).

The first refrigerant thus flowed out via the first gas inlet/outlet pipe (33) is sucked into the first compressor (52) via the first four-way switching valve (53) and boosted in pressure by the first compressor (52) again and sent to the outdoor air heat exchanger (51).

The second refrigerant thus flowed out via the second liquid inlet/outlet pipe (36) flows through the second outdoor expansion valve (64) in the outdoor unit (41) and is sent out from the outdoor unit (41) to the respective indoor units (42). The second refrigerant thus sent to the respective indoor units (42) is depressurized by the second indoor expansion valve (65) and sent to the indoor air heat exchanger (61), in which the second refrigerant absorbs heat to evaporate via heat exchange with indoor air. In this way, the indoor air is cooled down. The second refrigerant thus evaporated in the indoor air heat exchanger (61) is returned to the outdoor unit (41) from the indoor units (42) and sucked into the second compressor (62) via the second four-way switching valve (63), and is boosted in pressure by the second compressor (62) again and sent to the heat exchanger (100) according to the first embodiments.

—Heating Operation—

In the heat pump system (40), heating operation of the indoor units (42) is carried out in such a way that the first four-way switching valve (53) switches over the flow channel so that the first refrigerant, which has been boosted in pressure and temperature by the first compressor (52), is sent to the heat exchanger (100) according to the first embodiments. On the other hand, the second four-way switching valve (63) switches over the flow channel so that the second refrigerant, which has been boosted in pressure and temperature by the second compressor (62), is sent from the outdoor unit (41) to the indoor air heat exchangers (61) of the indoor units (42). The second refrigerant thus sent to the indoor air heat exchanger (61) releases heat to condense in the indoor air heat exchanger (61) through heat exchange with the indoor air. In this way, the indoor air is heated. The second refrigerant thus condensed in the indoor air heat exchanger (61) is depressurized by the second indoor expansion valves (65) in the indoor units (42) and is returned from the indoor units (42) to the outdoor unit (41). The second refrigerant thus returned to the outdoor unit (41) is sent to the heat exchanger (100) according to the first embodiments after depressurized by the second outdoor expansion valve (64) in the outdoor unit (41).

In the heat exchanger (100) according to the first embodiments, the first refrigerant flows thereinto via the first gas inlet/outlet pipe (33) and is distributed to the plurality of first layers (10), in each of which the first refrigerant flows through the plurality of first flow channels (12) via the first one end-side collective flow channel (17). Moreover, the second refrigerant flows into the heat exchanger (100) according to the first embodiments via the second liquid inlet/outlet pipe (36) and is distributed to the plurality of second layers (20), in each of which the second refrigerant flows through the plurality of second flow channels (22) via the second other end-side collective flow channel (29). When the first and second refrigerants flow in the first and second layers (10, 20) as above, the heat exchange takes place between the first and second layers (10, 20), thereby causing the first refrigerant to release heat to condense in the first layers (10) while causing the second refrigerant to absorb the heat to evaporate in the second layers (20). The first refrigerant thus condensed in the first layers (10) flows through the first other end-side collective flow channel (19) and flows out via the first liquid inlet/outlet pipe (35). The second refrigerant thus evaporated in the second layers (20) flows through the second one end-side collective flow channel (27) and flows out via the second liquid inlet/outlet pipe (36).

The first refrigerant thus flowed out via the first liquid inlet/outlet pipe (35) is sent to the outdoor air heat exchanger (51) after depressurized by the first expansion valve (54), and absorbs heat to evaporate in the outdoor air heat exchanger (51) through heat exchange with the outdoor air. The first refrigerant thus evaporated in the outdoor air heat exchanger (51) is sucked into the first compressor (52) via the first four-way switching valve (53), and boosted in pressure by the first compressor (52) again and sent to the heat exchanger (100) according to the first embodiments.

The second refrigerant thus flowed out via the second gas inlet/outlet pipe (34) is sucked into the second compressor (62) via the second four-way switching valve (63), and boosted in pressure by the second compressor (62) again and sent to the respective indoor units (42).

In the heat pump system (40) configured as above, it is possible to achieve the efficacies of space-saving and weight reduction of the heat exchanger (100) according to the first embodiments.

Second Embodiments

Figure 12:
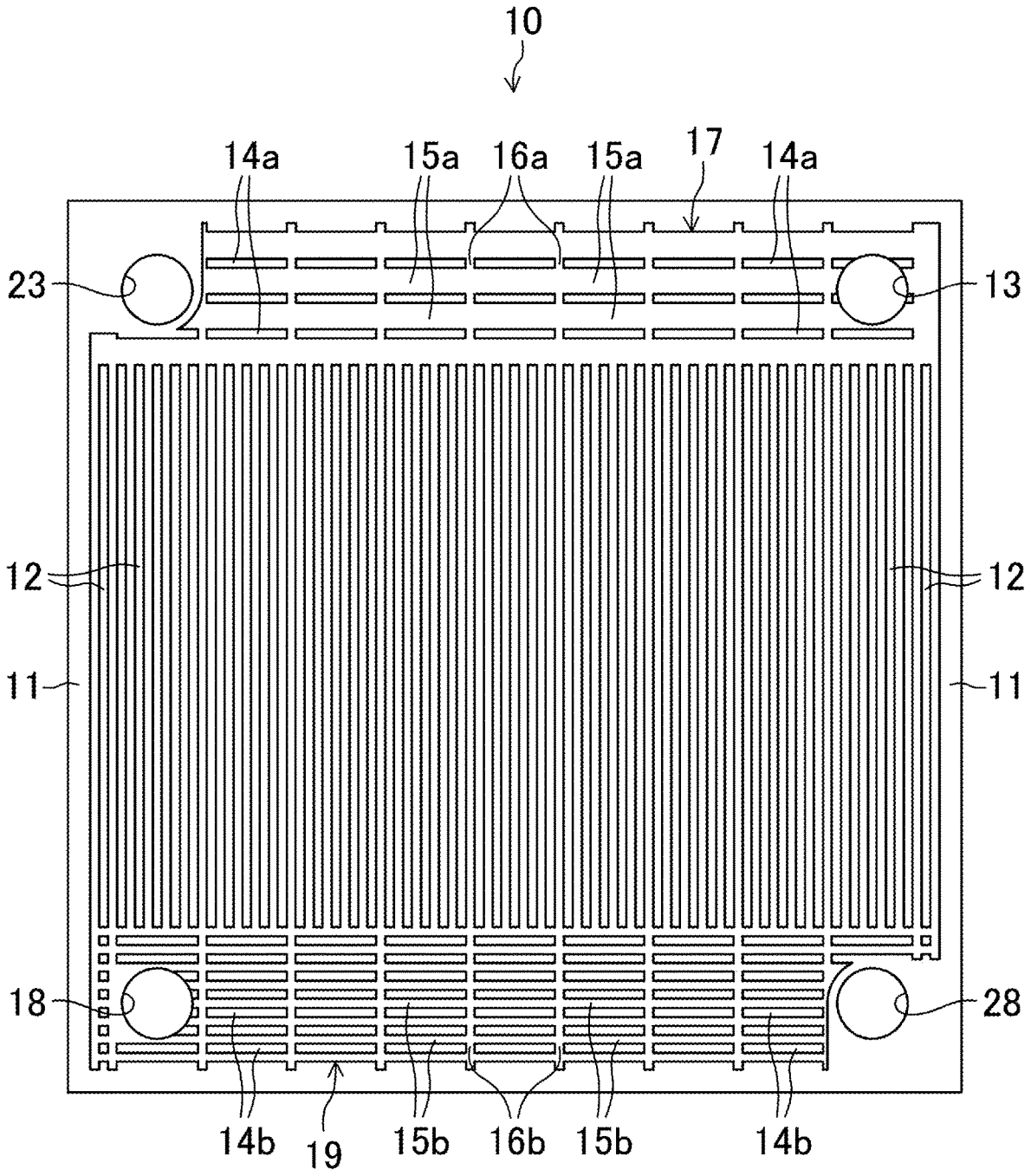
FIG. 12 is a plan view of a first layer (10) of second embodiments.
Figure 13:
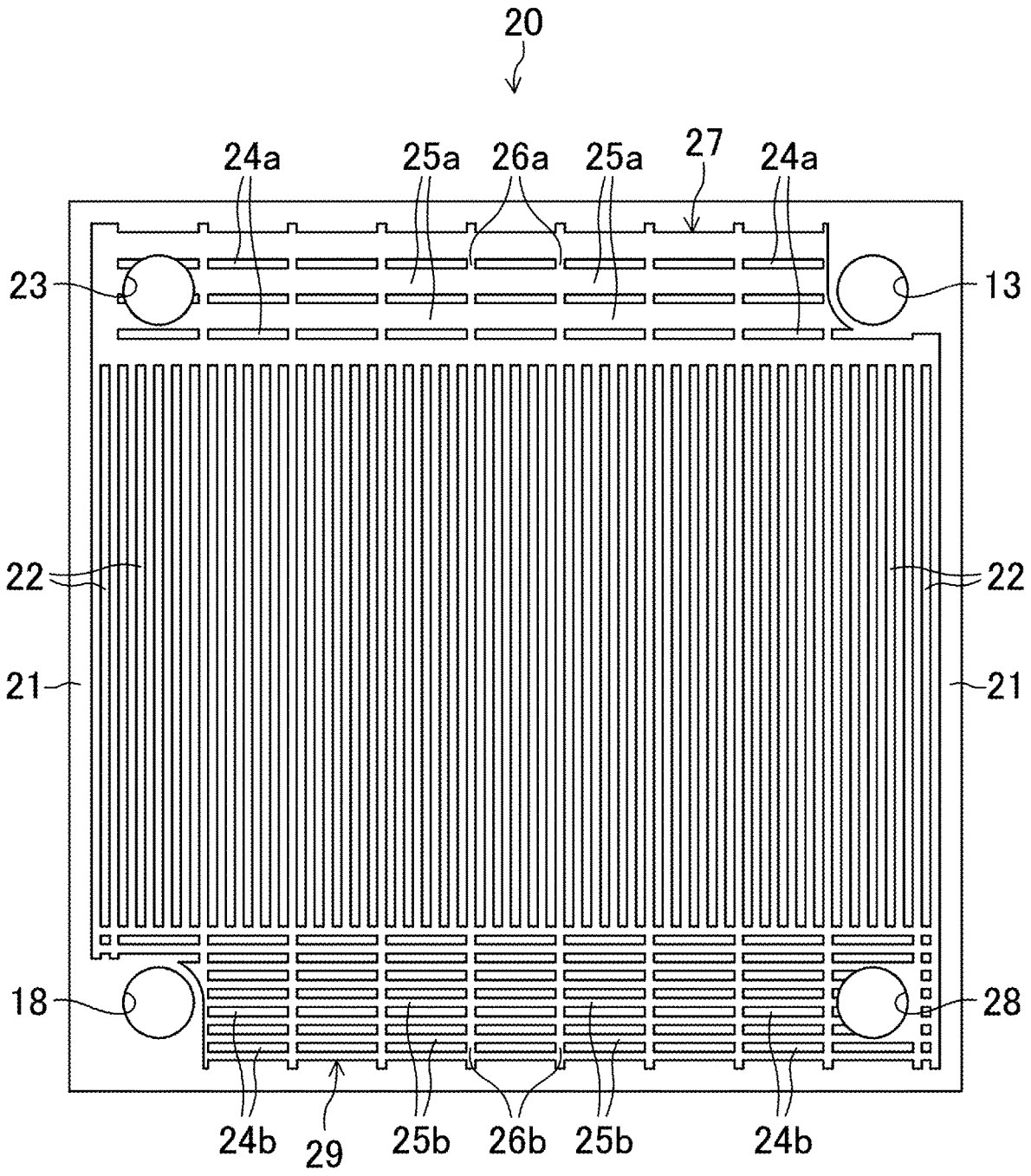
FIG. 13 is a plan view of a second layer (20) of the second embodiments.

FIG. 12 illustrates a first layer (10) of a heat exchanger (100) according to second embodiments. FIG. 13 illustrates a second layer (20) thereof. Like references used in the first embodiments are used for like parts herein.

In the heat exchanger (100) according to the second embodiments, a first one end-side collective flow channel (17) constitutes a gas flow channel, and therefore first microchannels A (15*a*) serve as gas flow channels (first gas flow channels) as well in the first layers (10). A first other end-side collective flow channel (19) functions as a liquid flow channel herein, and therefore first microchannels B (15*b*) serve as liquid flow channels (first liquid flow channels) as well. The first microchannels A and B (15*a*, 15*b*) are identical with each other in dimensions ($D_{A1}$, $D_{B1}$) in the lamination direction of the first and second layers (10, 20). A width dimension ($W_{A1}$) of the first microchannels A (15*a*) is greater than a width dimension ($W_{B1}$) of the first microchannels B (15*b*). Therefore, the first microchannels A (15*a*) serving as the first gas flow channels are greater than the first microchannels B (15*b*) serving as the first liquid flow channels in terms of flow channel cross-sectional area ($D_{A1}\times W_{A1}>D_{B1}\times W_{B1}$). For this reason, the first one end-side collective flow channel (17) has a capacity greater than that of the first other end-side collective flow channel (19).

Similarly, in the second layers (20), the second one end-side collective flow channel (27) constitutes a gas flow channel, and therefore second microchannels A (25*a*) serve as gas flow channels (second gas flow channels) as well. The second other end-side collective flow channel (29) functions as a liquid flow channel herein, and therefore the second microchannels B (25*b*) serve as liquid flow channels (second liquid flow channels) as well. The second microchannels A and B (25*a*, 25*b*) are identical with each other in dimensions ($D_{A2}$, $D_{B2}$) in the lamination direction of the first and second layers (10, 20). A width dimension ($W_{A2}$) of the second microchannels A (25*a*) is greater than a width dimension ($W_{B2}$) of the second microchannels B (25*b*). Therefore, the second microchannels A (25*a*) serving as the second gas flow channels are greater than the second microchannels B (25*b*) serving as the second liquid flow channels in terms of the flow channel cross-sectional area ($D_{A2}\times W_{A2}>D_{B2}\times W_{B2}$). For this reason, the second one end-side collective flow channel (27) has a greater capacity than that of the second other end-side collective flow channel (29).

In the heat exchanger (100) according to the second embodiments configured as above, the first microchannels A (15*a*) serving as the first gas flow channels are greater than the first microchannels B (15*b*) serving as the first liquid flow channels in terms of the flow channel cross-sectional area. Similarly, the second microchannels A (25*a*) serving as the second gas flow channels are greater than the second microchannels B (25*b*) serving as the second liquid flow channels in terms of the flow channel cross-sectional area. Because the volume of a gas of a certain mass is greater than the volume of a liquid of the same mass, this configuration in which the flow channel cross-sectional areas of the first and second gas flow channels are greater than those of the first and second liquid flow channels makes it possible to avoid an excessively large pressure loss that would be caused due to a high rate of the gas or gas-liquid mixture fluid flowing in the first and second gas flow channels. The embodiments are the same as or similar to the first embodiments in terms of the other configurations, and can attain the advantages same as or similar to those of the first embodiments.

Third Embodiments

Figure 14:
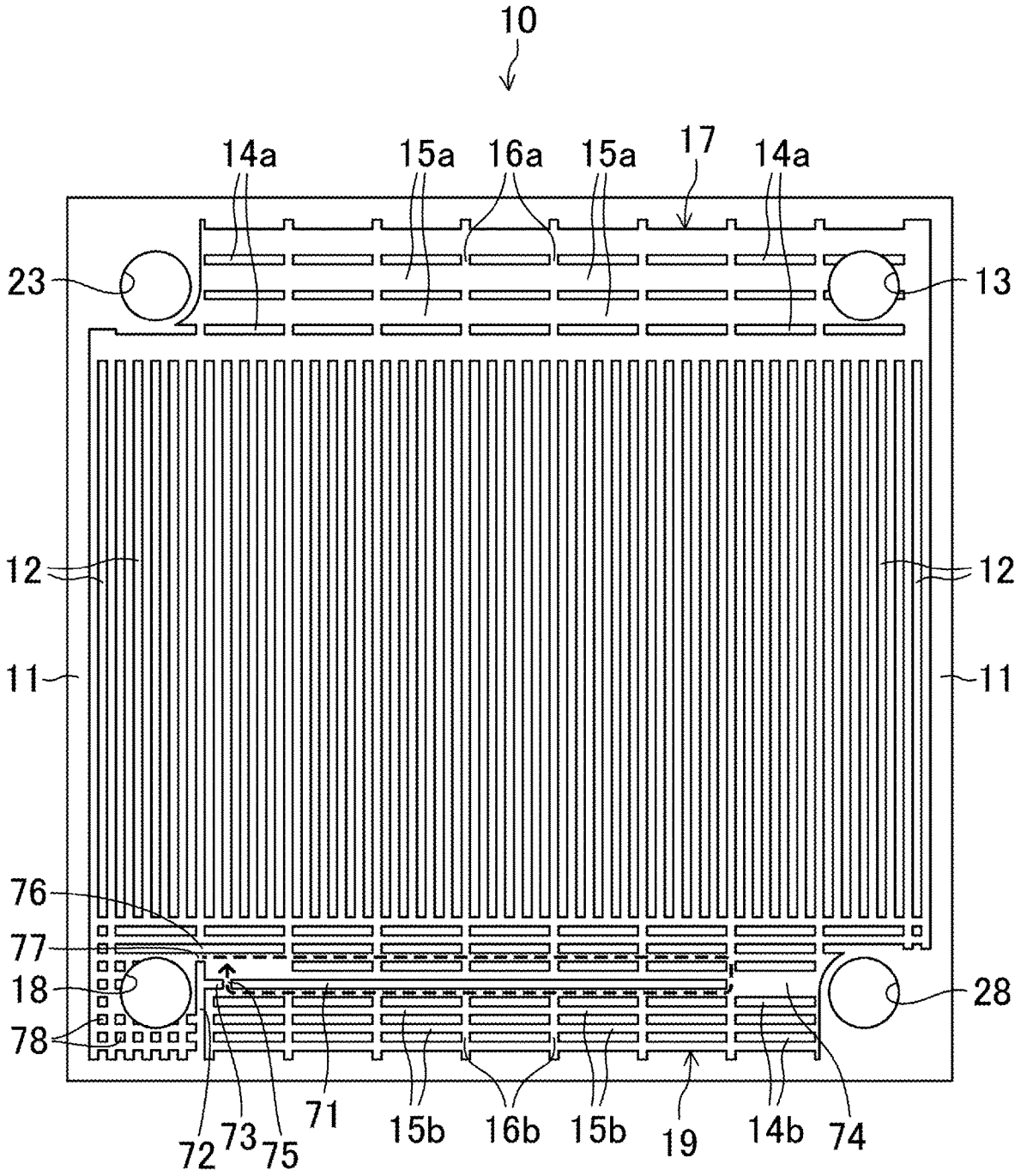
FIG. 14 is a plan view of a first layer (10) of third embodiments.
Figure 15:
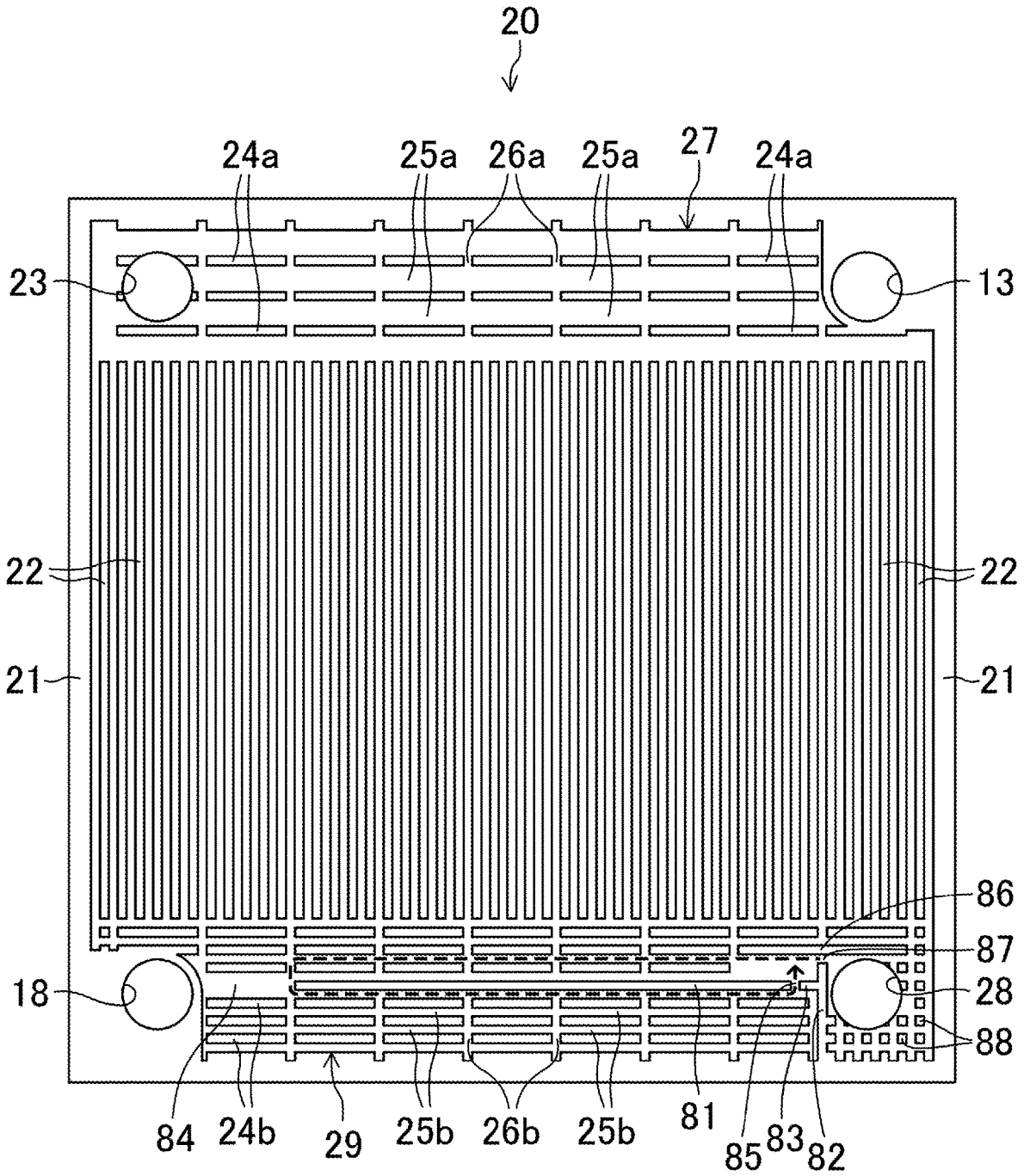
FIG. 15 is a plan view of a second layer (20) of the third embodiments.

FIG. 14 illustrates a first layer (10) of a heat exchanger (100) according to third embodiments. FIG. 15 illustrates a second layer (20) thereof. Like references used in the first embodiments are used for like parts herein.

In the heat exchanger (100) according to the third embodiments, the first layers (10) are configured such that a first other end-side collective flow channel (19) is provided with a first long ridge (71) extending in the right-left direction and having a rectangular cross section. The first long ridge (71) divides the region, in which first microchannels B (15*b*) are provided, into two parts aligned in the up-down direction.

On a right side of a first liquid transport section (18), a first longitudinal ridge (72) is provided, which extends from a peripheral portion (11) in the up-down direction and has a rectangular cross section. The first longitudinal ridge (72) serves as a partition by which the first liquid transport section (18) is parted in the right-left direction from the region in which the first microchannels B (15*b*) are provided. The first longitudinal ridge (72) is provided with a first small ridge (73) at a position corresponding to the first long ridge (71) in the up-down direction of the first longitudinal ridge (72), the first small ridge (73) extending rightward from the first longitudinal ridge (72) toward the first long ridge (71) and having a rectangular cross section.

On the right side of the first long ridge (71), which is a distal side with respect to the first liquid transport section (18), a first right-side flowable section (74) is provided, which provides up-down directional fluid communication between the parts divided by the first long ridge (71). On the left side of the first long ridge (71), which is a proximal side with respect to the first liquid transport section (18), a first left-side flowable section (75) is provided between the first long ridge (71) and the first small ridge (73), the first left-side flowable section (75) providing up-down directional fluid communication between the parts divided by the first long ridge (71). The first right-side flowable section (74) has a greater flow channel cross-sectional area than the first left-side flowable section (75).

On the upper side of the first liquid transport section (18), a first lateral ridge (76) extending in the right-left direction and having a rectangular cross section is provided. The first lateral ridge (76) serves as a partition by which the first liquid transport section (18) is parted in the up-down direction from the region in which the first flow channels (12) are provided, and the first lateral ridge (76) is positioned in a T shape-like orientation with the first longitudinal ridge (72) when viewed in the plan view. The left and right sides of the first lateral ridge (76) are open in the up-down direction for fluid communication.

Between a tip of the first longitudinal ridge (72) and the first lateral ridge (76), a first liquid ejecting section (77), which is a gap, is formed. The first liquid ejecting section (77) provides right-left directional fluid communication between the region in which the first liquid transport section (18) is provided and the upper one of the parts divided by the first long ridge (71).

In a peripheral region being around the first liquid transport section (18) and defined by the first longitudinal ridge (72) and the first lateral ridge (76), a plurality of first columnar structures (78) are provided, each of which has a square shape when viewed in the plan view. The plurality of first columnar structures (78) are arranged to form a square lattice when viewed in the plan view, thereby forming first microchannels B (15*b*) between the first columnar structures (78). Some of the first columnar structures (78) are integrated with the first longitudinal ridge (72).

In a case of evaporating a liquid in the first layers (10), a first fluid containing the liquid as the evaporation source is supplied to the first other end-side collective flow channel (19) via the first liquid transport section (18). In this case, as indicated by the broken line in FIG. 14, the first fluid flows in such a way that the first fluid is ejected from the first liquid ejecting section (77) rightward along the direction in which the plurality of first flow channels (12) are arranged side by side into the upper one of parts divided by the first long ridge (71). Part of the first fluid flows into the first flow channels (12) and the rest of the first fluid flows via the first right-side flowable section (74) into the lower one of the parts divided by the first long ridge (71). Thereafter, the first fluid flows in such a way that the first fluid is redirected to flow leftward in the direction in which the plurality of first flow channels (12) are arranged side by side, and the first fluid is ejected from the first left-side flowable section (75) into the upper one of the parts divided by the first long ridge (71), because the first right-side flowable section (74) has a greater flow channel cross-sectional area than the first left-side flowable section (75).

Similarly, in the second layers (20), a second long ridge (81) extending in the right-left direction and having a rectangular cross section is provided in the second other end-side collective flow channel (29). The second long ridge (81) divides the region, in which the second microchannels B (25*b*) are provided, into two parts aligned in the up-down direction.

On the left side of the second liquid transport section (28), a second longitudinal ridge (82) is provided, which extends from the peripheral portion (21) in the up-down direction and has a rectangular cross section. The second longitudinal ridge (82) serves as a partition by which the second liquid transport section (28) is parted in the right-left direction from the region in which the second microchannels B (25*b*) are provided. The second longitudinal ridge (82) is provided with a second small ridge (83) at a position corresponding to the second long ridge (81) in the up-down direction of the second longitudinal ridge (82), the second small ridge (83) extending leftward from the second longitudinal ridge (82) toward the second long ridge (81) and having a rectangular cross section.

On the left side of the second long ridge (81), which is a distal side with respect to the second liquid transport section (28), a second left-side flowable section (84) is provided, which provides up-down directional fluid communication between the parts divided by the second long ridge (81). On the right side of the second long ridge (81), which is a proximal side with respect to the second liquid transport section (28), a second right-side flowable section (85) is provided between the second long ridge (81) and the second small ridge (83), the second right-side flowable section (85) providing up-down directional fluid communication between the parts divided by the second long ridge (81). The second left-side flowable section (84) has a greater flow channel cross-sectional area than the second right-side flowable section (85).

On the upper side of the second liquid transport section (28), a second lateral ridge (86) extending in the right-left direction and having a rectangular cross section is provided. The second lateral ridge (86) serves as a partition by which the second liquid transport section (28) is parted in the up-down direction from the region in which the second flow channels (22) are provided, and the second lateral ridge (86) is positioned in a T shape-like orientation with the second longitudinal ridge (82) when viewed in the plan view. The left and right sides of the second lateral ridge (86) are open in the up-down direction for fluid communication.

Between a tip of the second longitudinal ridge (82) and the second lateral ridge (86), a second liquid ejecting section (87), which is a gap, is formed. The second liquid ejecting section (87) provides right-left directional fluid communication between the region in which the second liquid transport section (28) is provided and the upper one of the parts divided by the second long ridge (81).

In a peripheral region being around the second liquid transport section (28) and defined by the second longitudinal ridge (82) and the second lateral ridge (86), a plurality of second columnar structures (88) are provided, each of which has a square shape when viewed in the plan view. The plurality of second columnar structures (88) are arranged to form a square lattice when viewed in the plan view, thereby forming microchannels between the second columnar structures (88). Some of the second columnar structures (88) are integrated with the second longitudinal ridge (82).

In a case of evaporating a liquid in the second layers (20), a second fluid containing the liquid as the evaporation source is supplied to the second other end-side collective flow channel (29) via the second liquid transport section (28). In this case, as indicated by the broken line in FIG. 15, the second fluid flows in such a way that the second fluid is ejected from the second liquid ejecting section (87) leftward in the direction in which the plurality of second flow channels (22) are arranged side by side into the upper one of parts divided by the second long ridge (81). Part of the second fluid flows into the second flow channels (22) and the rest of the second fluid flows from the second left-side flowable section (84) into the lower one of the parts divided by the second long ridge (81). Thereafter, the second fluid flows in such a way that the second fluid is redirected to flow rightward in the direction in which the plurality of second flow channels (22) are arranged side by side, and the second fluid is ejected from the second right-side flowable section (85) into the upper one of the parts divided by the second long ridge (81), because the second left-side flowable section (84) has a greater flow channel cross-sectional area than the second right-side flowable section (85).

The heat exchanger (100) according to the third embodiments with the configuration described above is such that such a redirecting structure is provided in each of the first other end-side collective flow channel (19) for supplying into the first flow channels (12) the first fluid containing the liquid as the evaporation source and the second other end-side collective flow channel (29) for supplying into the second flow channels (22) the second fluid containing the liquid as the evaporation source.

In a case of evaporating the liquid in the first layers (10), the redirecting structure guides the first fluid containing the liquid as the evaporation source in such a way that the first fluid flows in one way in the direction in which the plurality of first flow channels (12) are arranged side by side, and, after that, the first fluid is redirected to flow in the other way to remerge into the flow flowing in the one way, so that the first fluid becomes uniform along the direction in which the plurality of first flow channels (12) are arranged side by side. As a result, it becomes possible to let the first fluid containing the liquid as the evaporation source flow uniformly into the plurality of first flow channels (12) regardless of how far or close the respective first flow channels (12) are distanced from the first liquid transport section (18) serving as a liquid supplying section.

In a case of evaporating the liquid in the second layers (20), the redirecting structure guides the second fluid containing the liquid as the evaporation source in such a way that the second fluid flows in one way in the direction in which the plurality of second flow channels (22) are arranged side by side, and, after that, the second fluid is redirected to flow in the other way to remerge into the flow flowing in the one way, so that the second fluid becomes uniform along the direction in which the plurality of second flow channels (22) are arranged side by side. As a result, it becomes possible to let the second fluid containing the liquid as the evaporation source flow uniformly into the plurality of second flow channels (22) regardless of how far or close the respective second flow channels (22) are distanced from the second liquid transport section (28) serving as a liquid supplying section.

The embodiments are the same as or similar to the second embodiments in terms of the other configurations, and can attain the advantages same as or similar to those of the second embodiments.

Other Embodiments

The first to third embodiments are so configured that the first microchannels A and B (15*a*, 15*b*) extend in the right-left direction perpendicular to the up-down direction in which the plurality of first flow channels (12) extend and the second microchannels A and B (25*a*, 25*b*) extend in the right-left direction perpendicular to the up-down direction in which the plurality of second flow channels (22) extend, but the present disclosure is not limited to such configurations and may be differently configured, provided that the first microchannels A and B (15*a*, 15*b*) extend in a direction crossing a direction in which the plurality of first flow channels (12) extend, and the second microchannels A and B (25*a*, 25*b*) extend in a direction crossing a direction in which the plurality of second flow channels (22) extend.

Figure 16:
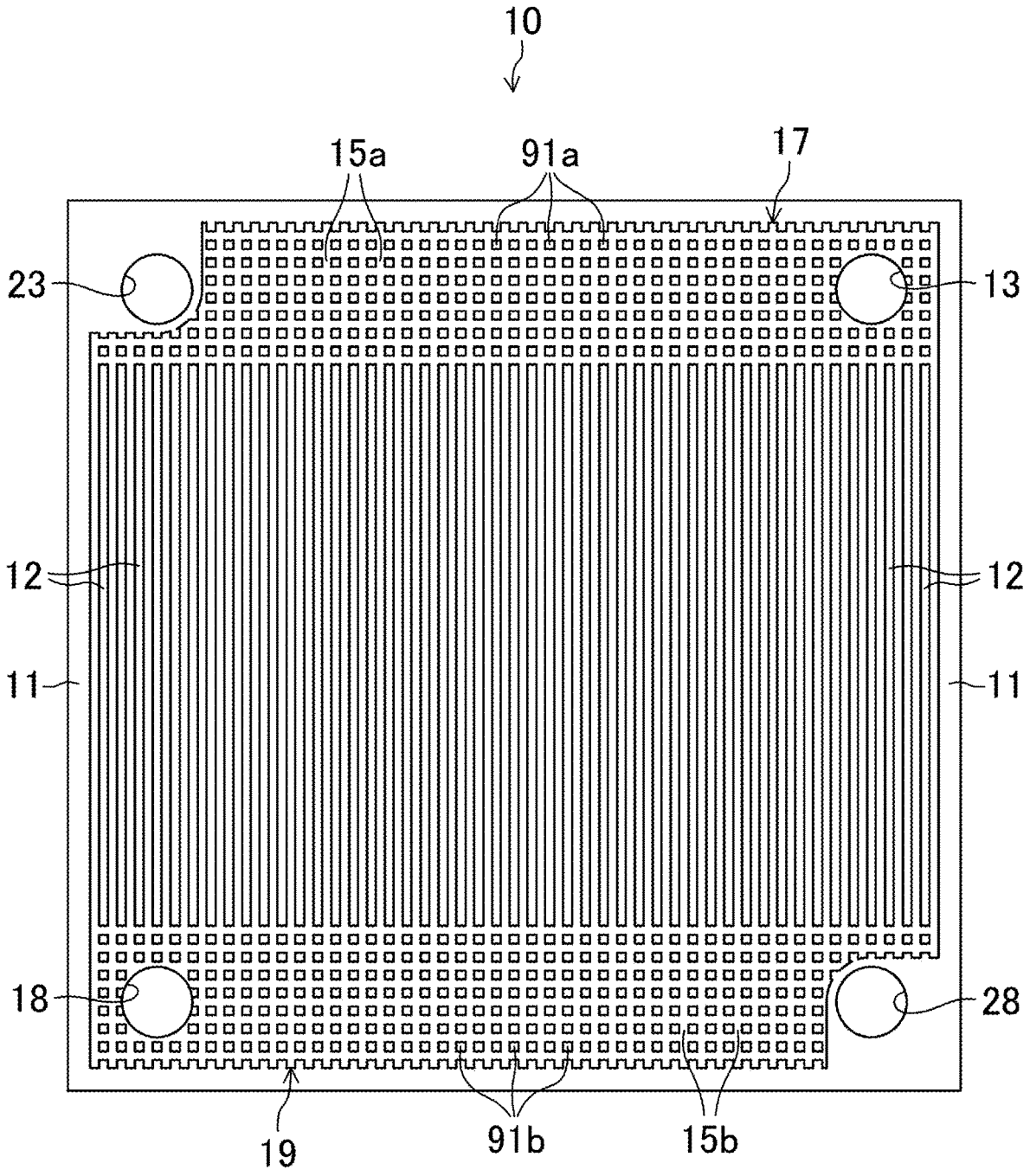
FIG. 16 is a plan view of a first layer (10) according to other embodiments.
Figure 17:
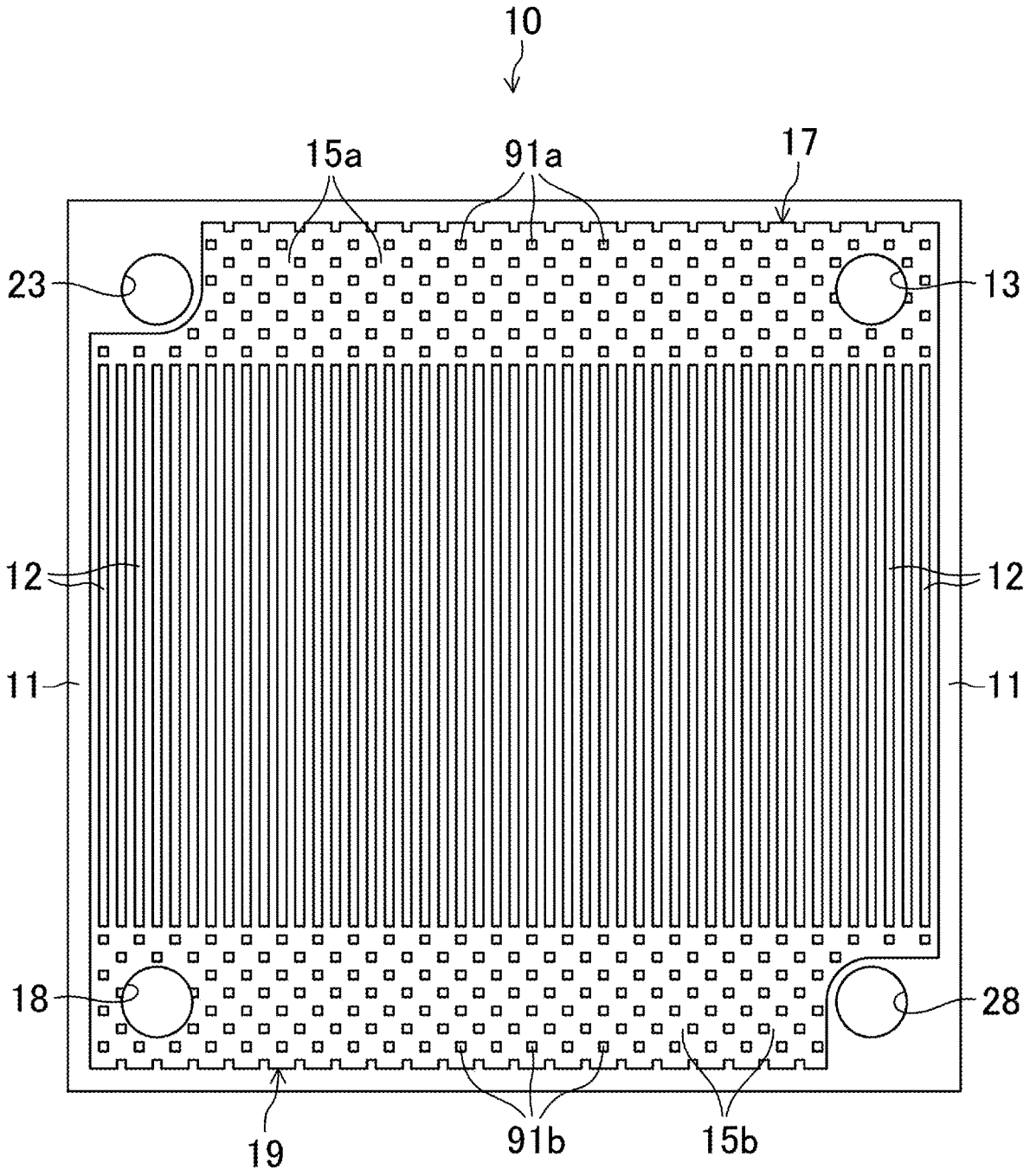
FIG. 17 is a plan view of a first layer (10) of another example according to other embodiments.

The first to third embodiments are so configured that the first microchannels A and B (15*a*, 15*b*) and the second microchannels A and B (25*a*, 25*b*) are configured as the grooves formed between the ridges (14*a*, 14*b*, 24*a*, 24*b*), but the present disclosure is not limited to such configurations and may be configured such that, for example as in the first layer (10) illustrated in FIGS. 16 and 17, pluralities of columnar structures A and B (91*a*, 91*b*) are provided with gaps therebetween so as to form the first microchannels A and B (15*a*, 15*b*) between the columnar structures A and B (91*a*, 91*b*).

The first to third embodiments are so configured that the first and second flow channels (12, 22) and the like are rectangular in cross section, but the present disclosure is not limited to such configurations and may be configured such that the first and/or second flow channels (12, 22) and/or the like have a cross section of another shape such as semicircular cross sections.

The first to third embodiments are so configured that the first and second flow channels (12, 22) and the like extend straightly, but the present disclosure is not limited to such configurations and may be so configured that the first and/or second flow channels (12, 22) and/or the like extend meanderingly or zigzag.

The present disclosure is applicable to the technical fields of heat exchangers and heat pump systems having the same.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

10, 20 First Layer, Second Layer
12, 22 First Flow Channel, Second Flow Channel
15*a*, 25*a* First Microchannel A, Second Microchannel A
15*b*, 25*b* First Microchannel B, Second Microchannel B
17, 27 First One End-Side Collective Flow Channel, Second One End-Side Collective Flow Channel
19, 29 First Other End-Side Collective Flow Channel, Second Other End-Side Collective Flow Channel
40 Heat Pump System
100 Heat Exchanger

What is claimed is:

1. A heat exchanger, comprising:

a first layer comprising first flow channels that are microchannels and arranged to extend side by side, wherein a first one end-side collective flow channel is in fluid communication with first ends of the first flow channels, and a first other end-side collective flow channel is in fluid communication with second ends of the first flow channels; and a second layer that is laminated on the first layer and that comprises second flow channels that are microchannels and arranged to extend side by side, wherein a second one end-side collective flow channel is in fluid communication with first ends of the second flow channels, and a second other end-side collective flow channel is in fluid communication with second ends of the second flow channels, wherein the first ends and the second ends of the first flow channels are positioned to align respectively in a direction perpendicularly crossing a direction in which the first flow channels extend, the first ends and the second ends of the second flow channels are positioned to align respectively in a direction perpendicularly crossing a direction in which the second flow channels extend, the first one end-side collective flow channel and the first other end-side collective flow channel each comprise first microchannels extending in a direction perpendicularly crossing a direction in which the first flow channels extend, the second one end-side collective flow channel and the second other end-side collective flow channel each comprise second microchannels extending in a direction perpendicularly crossing a direction in which the second flow channels extend, a dimensional ratio of width dimensions of the first microchannels in a direction perpendicular to a lamination direction of the first layer and the second layer with respect to a dimension of the first flow channels is greater than one and equal to or less than three, and a dimensional ratio of width dimensions of the second microchannels in the direction perpendicular to the lamination direction with respect to a dimension of the second flow channels is greater than one and equal to or less than three.

2. The heat exchanger according to claim 1, wherein dimensions of the first microchannels in the lamination direction are equal to a dimension of the first flow channels, and dimensions of the second microchannels in the lamination direction are equal to a dimension of the second flow channels.

3. The heat exchanger according to claim 1, wherein heat is exchanged such that gas condensates in one of the first layer or the second layer and liquid evaporates in another of the first layer or the second layer.

4. The heat exchanger according to claim 1, wherein each of fluids flowing in the first layer and the second layer is a CFC refrigerant or a natural refrigerant.

5. The heat exchanger according to claim 1, wherein the first microchannels extend parallel to each other, adjacent ones of the first microchannels of the first one end-side collective flow channel are in fluid communication with each other via a first one end-side bypass flow channel, adjacent ones of the first microchannels of the first other end-side collective flow channel are in fluid communication with each other via a first other end-side bypass flow channel, the second microchannels extend parallel to each other, adjacent ones of the second microchannels of the second one end-side collective flow channel are in fluid communication with each other via a second one end-side bypass flow channel, and adjacent ones of the second microchannels of the second other end-side collective flow channel are in fluid communication with each other via a second other end-side bypass flow channel.

6. The heat exchanger according to claim 2, wherein heat is exchanged such that gas condensates in one of the first layer or the second layer and liquid evaporates in another of the first layer or the second layer.

7. The heat exchanger according to claim 2, wherein each of fluids flowing in the first layer and the second layer is a CFC refrigerant or a natural refrigerant.

8. The heat exchanger according to claim 2, wherein the first microchannels extend parallel to each other, adjacent ones of the first microchannels of the first one end-side collective flow channel are in fluid communication with each other via a first one end-side bypass flow channel, adjacent ones of the first microchannels of the first other end-side collective flow channel are in fluid communication with each other via a first other end-side bypass flow channel, the second microchannels extend parallel to each other, adjacent ones of the second microchannels of the second one end-side collective flow channel are in fluid communication with each other via a second one end-side bypass flow channel, and adjacent ones of the second microchannels of the second other end-side collective flow channel are in fluid communication with each other via a second other end-side bypass flow channel.

9. The heat exchanger according to claim 6, wherein one or more of followings:

with respect to the first microchannels, either one of the first microchannels of the first one end-side collective flow channel or the first microchannels of the first other end-side collective flow channel are first gas flow channels, another of the first microchannels of the first one end-side collective flow channel or the first microchannels of the first other end-side collective flow channel are first liquid flow channels, and a flow channel cross-sectional area of the first gas flow channels is larger than a flow channel cross-sectional area of the first liquid flow channels, and with respect to the second microchannels, either one of the second microchannels of the second one end-side collective flow channel or the second microchannels of the second other end-side collective flow channel are second gas flow channels, another of the second microchannels of the second one end-side collective flow channel or the second microchannels of the second other end-side collective flow channel are second liquid flow channels, and a flow channel cross-section area of the second gas flow channels is larger than a flow channel cross-section area of the second liquid flow channels.

10. The heat exchanger according to claim 6, further comprising:

a redirecting structure in each of collective flow channels, wherein the collective flow channels:

are:

either of the first one end-side collective flow channel or the first other end-side collective flow channel; and either of the second one end-side collective flow channel or the second other end-side collective flow channel, and supply a fluid containing a liquid as an evaporation source to the first flow channels or the second flow channels, and the redirecting structure guides the fluid such that, where the fluid flows in a direction in which the first flow channels or the second flow channels receiving supply of the fluid are arranged side by side, after the redirecting structure, the fluid is redirected to flow in an opposite direction to the direction in which the fluid flows before the redirecting structure and remerges into the fluid flowing in the direction in which the fluid flows before the redirecting structure.

11. The heat exchanger according to claim 6, wherein each of fluids flowing in the first layer and the second layer is a CFC refrigerant or a natural refrigerant.

12. The heat exchanger according to claim 6, wherein the first microchannels extend parallel to each other, adjacent ones of the first microchannels of the first one end-side collective flow channel are in fluid communication with each other via a first one end-side bypass flow channel, adjacent ones of the first microchannels of the first other end-side collective flow channel are in fluid communication with each other via a first other end-side bypass flow channel, the second microchannels extend parallel to each other, adjacent ones of the second microchannels of the second one end-side collective flow channel are in fluid communication with each other via a second one end-side bypass flow channel, and adjacent ones of the second microchannels of the second other end-side collective flow channel are in fluid communication with each other via a second other end-side bypass flow channel.

13. The heat exchanger according to claim 9, further comprising:

a redirecting structure in each of collective flow channels, wherein the collective flow channels:

are:

either of the first one end-side collective flow channel or the first other end-side collective flow channel; and either of the second one end-side collective flow channel or the second other end-side collective flow channel, and supply a fluid containing a liquid as an evaporation source to the first flow channels or the second flow channels, and the redirecting structure guides the fluid such that, where the fluid flows in a direction in which the first flow channels or the second flow channels receiving supply of the fluid are arranged side by side, after the redirecting structure, the fluid is redirected to flow in an opposite direction to the direction in which the fluid flows before the redirecting structure and remerges into the fluid flowing in the direction in which the fluid flows before the redirecting structure.

14. The heat exchanger according to claim 9, wherein each of fluids flowing in the first layer and the second layer is a CFC refrigerant or a natural refrigerant.

15. The heat exchanger according to claim 9, wherein the first microchannels extend parallel to each other, adjacent ones of the first microchannels of the first one end-side collective flow channel are in fluid communication with each other via a first one end-side bypass flow channel, adjacent ones of the first microchannels of the first other end-side collective flow channel are in fluid communication with each other via a first other end-side bypass flow channel, the second microchannels extend parallel to each other, adjacent ones of the second microchannels of the second one end-side collective flow channel are in fluid communication with each other via a second one end-side bypass flow channel, and adjacent ones of the second microchannels of the second other end-side collective flow channel are in fluid communication with each other via a second other end-side bypass flow channel.

16. The heat exchanger according to claim 10, wherein each of fluids flowing in the first layer and the second layer is a CFC refrigerant or a natural refrigerant.

17. The heat exchanger according to claim 10, wherein the first microchannels extend parallel to each other, adjacent ones of the first microchannels of the first one end-side collective flow channel are in fluid communication with each other via a first one end-side bypass flow channel, adjacent ones of the first microchannels of the first other end-side collective flow channel are in fluid communication with each other via a first other end-side bypass flow channel, the second microchannels extend parallel to each other, adjacent ones of the second microchannels of the second one end-side collective flow channel are in fluid communication with each other via a second one end-side bypass flow channel, and adjacent ones of the second microchannels of the second other end-side collective flow channel are in fluid communication with each other via a second other end-side bypass flow channel.

18. A heat pump system comprising the heat exchanger according to claim 1.

* * * * *